US009612047B2

(12) United States Patent
Higashiiue et al.

(10) Patent No.: US 9,612,047 B2
(45) Date of Patent: Apr. 4, 2017

(54) REFRIGERATION CYCLE APPARATUS AND REFRIGERANT CIRCULATION METHOD

(75) Inventors: Shinya Higashiiue, Tokyo (JP); Takashi Okazaki, Tokyo (JP); So Nomoto, Tokyo (JP); Hirokazu Minamisako, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 1245 days.

(21) Appl. No.: 13/583,323

(22) PCT Filed: Jan. 26, 2011

(86) PCT No.: PCT/JP2011/051469

§ 371 (c)(1),
(2), (4) Date: Sep. 7, 2012

(87) PCT Pub. No.: WO2011/122085

PCT Pub. Date: Oct. 6, 2011

(65) Prior Publication Data

US 2013/0042640 A1 Feb. 21, 2013

(30) Foreign Application Priority Data

Mar. 31, 2010 (JP) ..... 2010-081125

(51) Int. Cl.
*F25B 41/00* (2006.01)
*F25B 49/00* (2006.01)
(Continued)

(52) U.S. Cl.
CPC ..... *F25B 41/00* (2013.01); *F25B 40/00* (2013.01); *F25B 47/025* (2013.01);
(Continued)

(58) Field of Classification Search
CPC F25B 9/08; F25B 2400/04; F25B 2400/0403; F25B 2400/0407;
(Continued)

(56) References Cited

U.S. PATENT DOCUMENTS 6,718,781 B2 * 4/2004 Freund ..... F25B 49/02 62/199
7,207,186 B2 * 4/2007 Hirota ..... F04B 27/1804 62/228.3
(Continued)

FOREIGN PATENT DOCUMENTS

EP 2 492 612 A1 8/2012
JP 2003-97868 A 4/2003
(Continued)

OTHER PUBLICATIONS

Office Action (Notification of Reasons for Refusal) dated Nov. 20, 2012, issued in corresponding Japanese Patent Application No. 2010-081125, and an English Translation thereof. (7 pages).
(Continued)

*Primary Examiner* — Marc Norman
*Assistant Examiner* — Daniel C Comings
(74) *Attorney, Agent, or Firm* — Buchanan Ingersoll & Rooney PC

(57) ABSTRACT

An internal heat exchanger and a first flow control valve are connected in series between a condenser and a refrigerant inlet of an ejector. A gas refrigerant outlet of a gas-liquid separator is connected to a suction port of a compressor. A first bypass circuit connects a refrigerant outlet of the condenser to an intermediate pressure portion of the compressor via a second flow control valve and the internal heat exchanger. A second bypass circuit connects a refrigerant outlet of the internal heat exchanger to the liquid refrigerant outlet of the gas-liquid separator via a third flow control
(Continued)

valve. While the second flow control valve is opened such that the refrigerant flows through the first bypass circuit, the fourth flow control valve is switched to be opened or closed, and the third flow control valve is switched to be closed or opened.

9 Claims, 19 Drawing Sheets

(51) Int. Cl.

| | |
|---|---|
| ***F25B 1/06*** | (2006.01) |
| ***F25B 39/04*** | (2006.01) |
| *F25B 40/00* | (2006.01) |
| *F25B 47/02* | (2006.01) |

(52) U.S. Cl.
CPC ..... *F25B 2341/0012* (2013.01); *F25B 2400/0407* (2013.01); *F25B 2400/0411* (2013.01); *F25B 2400/05* (2013.01); *F25B 2400/13* (2013.01); *F25B 2400/16* (2013.01); *F25B 2400/23* (2013.01); *Y10T 29/49359* (2015.01)

(58) Field of Classification Search
CPC ..... F25B 2400/0409; F25B 2400/0411; F25B 2400/05; F25B 2400/16; F25B 2400/23
USPC .... 62/191, 196.2, 196.4, 197, 500, 509, 513
See application file for complete search history.

(56) References Cited

U.S. PATENT DOCUMENTS

| | | | | |
|---|---|---|---|---|
| 2003/0066301 | A1* | 4/2003 | Takeuchi ..... | B60H 1/3204 62/191 |
| 2005/0178150 | A1* | 8/2005 | Oshitani ..... | F25B 5/00 62/500 |

FOREIGN PATENT DOCUMENTS

| | | | |
|---|---|---|---|
| JP | 2003-279177 | A | 10/2003 |
| JP | 2004-37057 | A | 2/2004 |
| JP | 2005-76914 | A | 3/2005 |
| JP | 2006308181 | A | 11/2006 |
| JP | 2007-263440 | A | 10/2007 |
| JP | 2008-96095 | A | 4/2008 |
| JP | 2008-116124 | A | 5/2008 |
| JP | 2009-24939 | A | 2/2009 |
| JP | 2009-270785 | A | 11/2009 |

OTHER PUBLICATIONS

*International Search Report (PCT/ISA/210) issued on Mar. 8, 2011, by the Japanese Patent Office as the International Searching Authority for International Application No. PCT/JP2011/051469.
Office Action issued on Mar. 31, 2014, by the Chinese Patent Office in corresponding Chinese Patent Application No. 201180016373.2, and an English Translation of the Office Action. (18 pages).
Extended European Search Report issued on Aug. 31, 2016 by the European Patent Office in corresponding European Patent Application No. 11762326.4 (8 pages).

* cited by examiner (a)

(b)

| | CIRCUIT 1 | CIRCUIT 2 | CIRCUIT 3 | CIRCUIT 4 |
|---|---|---|---|---|
| FLOW CONTROL VALVE, OUTDOOR AIR EXAMPLE | LOWER THAN A | A~B | B~C | EQUAL TO OR HIGHER THAN C |
| 105 | × | ○ | ○ | × |
| 109 | ○ | ○ | × | × |
| 111 | ○ | × | × | ○ |
| 113 | × | ○ | ○ | × |
| HIGH-CAPACITY OPERATION | ○ | ○ | — | — |
| HIGH-EFFICIENCY OPERATION | — | ○ | ○ | — |

(a)

(b)

REFRIGERATION CYCLE APPARATUS AND REFRIGERANT CIRCULATION METHOD

TECHNICAL FIELD

The present invention generally relates to refrigeration cycle apparatuses provided with an ejector, and particularly relates to a refrigeration cycle apparatus capable of performing a high-capacity operation using a compressor having an injection and a high-efficiency operation due to a power recovery effect of an ejector in a low-outdoor-air-temperature environment.

BACKGROUND ART

A related-art refrigeration cycle apparatus provided with an ejector is configured to suppress decreasing an evaporation capacity and an operating efficiency by lowering a refrigerant flow rate into an evaporator due to a shortage of a driving power of the ejector (see Patent Literature 1, for example).

The related-art device includes a check valve bridge circuit for using the ejector in both a cooling operation and a heating operation. Further, a bypass circuit for bypassing the check valve bridge circuit connects a high-pressure-side inlet to a low-pressure-side outlet of the check valve bridge circuit with a refrigerant pipe and a bypass valve. A refrigerant circuit is formed such that when the evaporation capacity and the efficiency of the refrigeration cycle decrease due to the shortage of the recovery power in the ejector, this bypass circuit opens the bypass valve and fully closes a valve of a nozzle in the ejector so as to reduce a pressure using a regular expansion valve without using the ejector.

With this configuration, the refrigeration cycle apparatus can perform a high-efficiency operation due to power recovery of the ejector and provide high reliability due to a provision of the bypass circuit. Also, since the high-temperature heat source on the load side can be used during a defrosting operation, it is possible to reduce the time required for the defrosting operation. Thus, the suspension time of a heating operation is reduced, which makes it possible to prevent a reduction in comfort.

Further, with regard to refrigeration cycle apparatuses that provide improved heating capacity using a compressor having an injection port, a refrigeration cycle apparatus is known that has a configuration in which an outlet-side pipe of a condenser is connected to an injection port through a throttle mechanism and an internal heat exchanger by piping, for example. With this configuration, the throttle mechanism controls the injection flow rate. Further, in order to prevent liquid injection into a compressor, a refrigerant having a high dryness due to heat exchange by the internal heat exchanger is injected. Thus, it is possible to improve the reliability of the compressor (see Patent Literature 2, for example).

CITATION LIST

Patent Literature

Patent Literature 1: Japanese Unexamined Patent Application Publication No. 2008-116124 (claim 1, FIG. 1)

Patent Literature 2: Japanese Unexamined Patent Application Publication No. 2009-024939 (claim, FIG. 1)

SUMMARY OF INVENTION

Technical Problem

A problem with the related-art devices is that, during a heating operation under a low-outdoor-air-temperature condition, the suction density of the compressor is reduced due to a reduction in the evaporating pressure, which reduces the refrigerant circulation volume, and thus reduces the heating capacity. Another problem is that when the refrigerant circulation volume is increased by increasing the compressor frequency in order to improve the heating capacity, the power consumption of the compressor increases, so that the operating efficiency of the refrigeration cycle decreases.

The present invention has been made to overcome the above problems, and aims to provide a refrigeration cycle apparatus with improved heating capacity and improved efficiency under a low-outdoor-air-temperature condition.

Solution to Problem

A refrigeration cycle apparatus according to the present invention includes: a high-pressure-side refrigerant circuit in which a compressor, a condenser, an ejector, and a gas-liquid separator are connected in series with a refrigerant pipe; a low-pressure refrigerant circuit in which a liquid refrigerant that has flowed out of the gas-liquid separator flows through a fourth flow control valve 113 and an evaporator to a refrigerant suction port of the ejector; a compressor suction circuit that connects an upper outlet of the gas-liquid separator to a suction port of the compressor such that a gas refrigerant that has flowed out of the gas-liquid separator is suctioned into the compressor;

a first bypass circuit that connects a point between the condenser and the ejector of the high-pressure refrigerant circuit to an intermediate pressure portion of the compressor via a second flow control valve 109; an internal heat exchanger that exchanges heat between a refrigerant whose pressure has been reduced at the second flow control valve 109 of the first bypass circuit and a high-pressure refrigerant flowing in the high-pressure-side refrigerant circuit; and a second bypass circuit that connects a point between a first flow control valve 105 and the internal heat exchanger to a point between the fourth flow control valve 113 and the evaporator of the low-pressure refrigerant circuit via a third flow control valve 111 so as to allow the high-pressure refrigerant to take a bypass, the first flow control valve 105 being disposed between the internal heat exchanger and the ejector. While the second flow control valve 109 is opened such that the refrigerant flows through the first bypass circuit, the fourth flow control valve 113 is switched to be opened or closed, and the third flow control valve 111 is switched to be closed or opened.

Advantageous Effects of Invention

The refrigeration cycle apparatus according to the present invention can provide improved heating capacity by increasing the refrigerant circulation volume in the high-pressure-side refrigerant circuit with use of the first bypass circuit, and can perform a high-efficiency operation due to power recovery by the ejector.

Further, in the case where a nozzle portion of the ejector is clogged with impurities inside the refrigeration cycle, the refrigeration cycle apparatus uses the second bypass circuit and thus can prevent its operation from being stopped.

DESCRIPTION OF EMBODIMENTS

Embodiment 1

Figure 1:
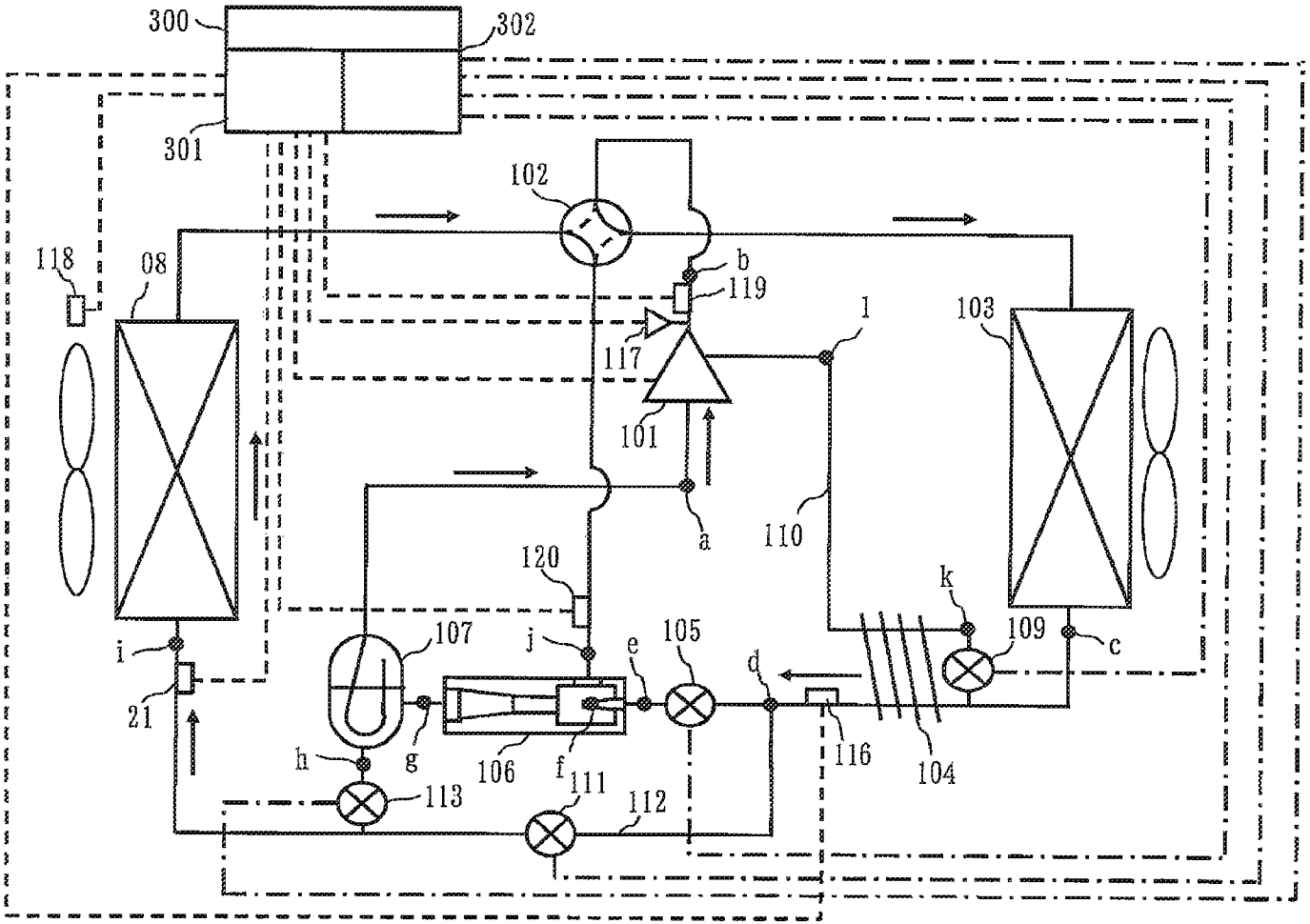
FIG. 1 is a schematic diagram showing a refrigeration cycle apparatus according to Embodiment 1 of the present invention.

FIG. 1 is a schematic diagram showing a configuration of a refrigeration cycle apparatus according to Embodiment 1 of the present invention. The refrigeration cycle apparatus of the present invention includes a compressor 101, a four-way valve 102, a condenser 103 serving as a radiator, a supercooler 104 that cools a refrigerant that has flowed out of the condenser 103, a first flow control valve 105, an ejector 106, and a gas-liquid separator 107 that separates a two-phase gas-liquid refrigerant that has flowed out of the ejector 106 into a liquid refrigerant and a gas refrigerant. This gas-liquid separator 107 has a liquid refrigerant side connected to an evaporator 108 by piping, and has a gas refrigerant side connected to a low-pressure suction port of the compressor 101. An outlet of the evaporator is connected to a suction portion 204 of the ejector 106 via the four-way valve 102. A first bypass circuit 110 is configured to cause a refrigerant to pass from a point between the condenser 103 and the supercooler 104 through a low-pressure-side pipe of the supercooler 104 via a second flow control valve 109 and inject the refrigerant into an injection port, which is an intermediate-pressure portion, of the compressor 101. A second bypass circuit 112 connects a point between the supercooler 104 and the first flow control valve 105 to a liquid pipe of the gas-liquid separator via a third flow control valve 111. A fourth flow control valve 113 is connected to a liquid refrigerant outlet of the gas-liquid separator 107. In the pipes in which the refrigerant circulates, there are provided a supercooler outlet temperature sensor 116, a high-pressure temperature sensor 119, an ejector suction temperature sensor 120, and an evaporator inlet temperature sensor 121. Signals detected by various sensors, such as an outdoor air temperature sensor 118 and a high-pressure sensor 117, are transmitted into a detected value receiver 301 in a control unit 300 which is provided outside. Various signals are processed by arithmetic means provided in a microcomputer in the control unit, and are compared to various stored setting values to lead determinations. Then, various actuators, various valves, the compressor, and the ejector are controlled in accordance with control signals transmitted from a control signal transmitter 302.

Figure 2:
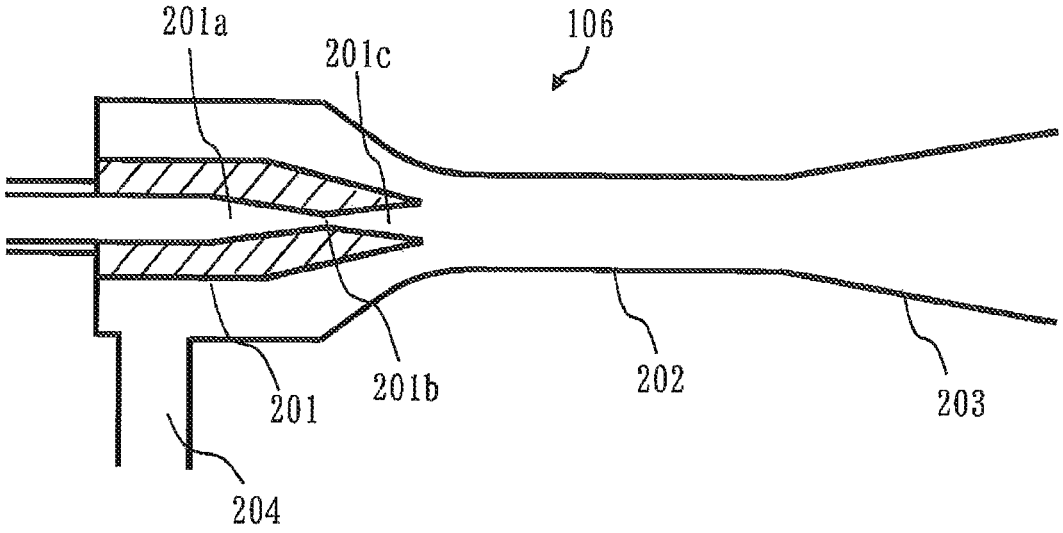
FIG. 2 is a schematic diagram showing an internal structure of an ejector of the refrigeration cycle apparatus according to Embodiment 1 of the present invention.

FIG. 2 is a configuration diagram of the ejector 106. The ejector 106 includes a nozzle portion 201, a mixing portion 202, and a diffuser portion 203. The nozzle portion 201 includes a pressure reducing portion 201*a*, a throat portion 201*b*, and a tapered portion 201*c*.

The ejector 106 decompresses and expands a high-pressure refrigerant, which is a driven flow, in the pressure reducing portion 201*a*, accelerates the refrigerant to a sonic speed in the nozzle throat portion 201*b*, and further decompresses and accelerates the refrigerant to a supersonic speed in the tapered portion 201*c*. The refrigerant, that is, the driven flow may be either in a supercooled liquid state or in a two-phase gas-liquid flow state. The refrigerant is suctioned through the suction portion 204 from the surrounding area (suction refrigerant). The driven refrigerant and the suction refrigerant in the ejector 106 are mixed in the mixing portion 202, so that the pressure is recovered (increased) through exchange of momentum therebetween. The pressure is further recovered in the diffuser portion 203 by the decelerating effect due to an expansion of the passage. Then, the refrigerant flows out of the diffuser portion 203.

Next, operations are described in a heating operation, for example.

Figure 3:
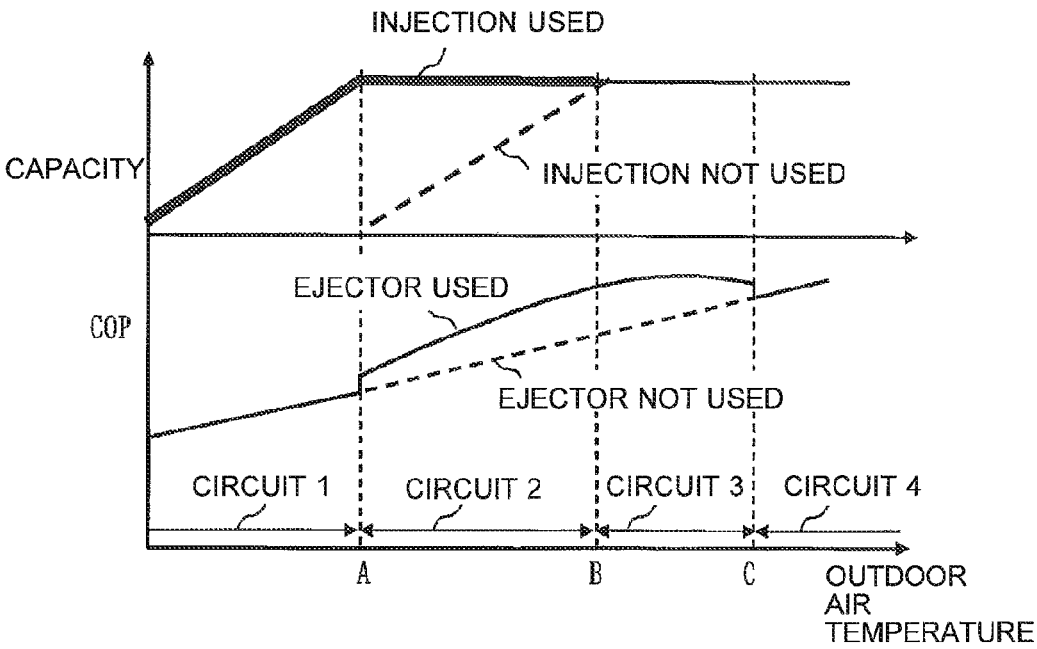
FIG. 3 is a chart showing a relationship between the outdoor air temperature and the heating capacity and a relationship between the outdoor air temperature and the COP according to Embodiment 1.

FIG. 3 shows a relationship between the outdoor air temperature and the capacity and a relationship between the outdoor air temperature and the COP in a heating operation. FIG. 3 also shows a relationship between flow control valves that are controlled in each temperature range. In FIG. 3, a relationship between the outdoor air temperature and the COP that is the capacity the efficiency of the refrigeration cycle apparatus of FIG. 1 are shown. The upper figure (a) is a conceptual chart illustrating the state in which injection is used and the ejector is used in the same outdoor air temperature range A-B. The lower figure (b) is a table illustrating an example in which specific circuits are actually used. In the figure, the horizontal axis represents the outdoor air temperature, and the vertical axis represents the capacity and the COP. It should be noted that, in FIG. 3, the broken lines indicate properties in the case where injection is not used and in the case where the ejector is not used, respectively. In FIG. 3(*a*), if injection is not used, the capacity decreases when the outdoor air temperature is equal to or lower than B. On the other hand, if injection is used, it is possible to maintain the same capacity until the outdoor air temperature falls to A which is lower than B. If the ejector is appropriately used, the efficiency can be increased compared to a case in which the ejector is not used. If the outdoor air temperature is low (e.g., lower than 2 degrees C.), the suction density of the compressor is reduced due to a reduction in the evaporating pressure. Therefore, the flow rate of the refrigerant discharged from the compressor decreases, and the heating capacity decreases. In this case, if the refrigerant flow rate is increased by increasing the rotation speed of the compressor, the power consumption of the compressor increases, so that the COP decreases. The following describes an operation with improved heating capacity using a compressor having an injection port and an efficient operation using an ejector with reference to FIG. 3(*b*) and a Mollier chart of FIG. 4. In the Mollier chart of FIG. 4, the horizontal axis represents the specific enthalpy, and the vertical axis represents the pressure. Points "a"-"l" in the chart indicate the states of the refrigerant at the respective points in the pipes of the refrigeration cycle of FIG. 1.

The compressor having an injection port makes a refrigerant injected into an intermediate pressure of the compressor so as to increase the refrigerant circulation volume in the compressor, and thereby improves the capacity. On the other hand, the ejector recovers the expansion power that has been generated in an expansion process of the refrigerant and utilizes the recovered power so as to reduce the power consumption of the compressor, and thereby improves the COP. In this case, the opening degrees of the first flow control valve 105, the second flow control valve 109, and the fourth flow control valve 113 are set in accordance with a control operation described below, while the third flow control valve 111 is fully closed.

A low-pressure refrigerant in a state "a" at a suction port of the compressor 101 is compressed to be in a state "b" by the compressor 101. The refrigerant in the state "b" passes through the refrigerant four-way valve 102 and is cooled in the condenser 103 through heat exchange with the indoor air so as to be in a state "c". The refrigerant in the state "c" is divided into a refrigerant that flows toward a refrigerant inlet of the ejector 106 and a refrigerant that flows toward the first bypass circuit 110. The refrigerant in the state "c" that has flowed into the first bypass circuit 110 is subjected to pressure reduction by the second flow control valve 109 so as to be in a state "k", and then flows into a low-pressure-side inlet of the supercooler 104. On the other hand, the high-temperature high-pressure refrigerant in the state "c" flowing toward the ejector 106 flows into a high-pressure-side inlet of the supercooler. In the supercooler 104, the high-temperature high-pressure refrigerant in the state "k" and the low-temperature low-pressure refrigerant in the state "c" exchange heat with each other. Thus, the refrigerant in the state "k" is heated so as to be in a state "l", and then is injected into the intermediate pressure of the compressor. On the other hand, the refrigerant in the state "c" is cooled so as to be in a state "d", and flows toward the ejector 106.

The refrigerant in the state "d" flowing toward the ejector 106 is subjected to pressure reduction by the first flow control valve 105 so as to be in a state "e", is subjected to pressure reduction by the pressure reducing portion 201*a* so as to be in a state "f", and is ejected from a nozzle outlet as a high-speed two-phase gas-liquid refrigerant. The refrigerant in the state "f" immediately after ejection from the nozzle outlet is mixed with the refrigerant in a state "j" that has flowed from the ejector suction portion 204. After the pressure is increased in the mixing portion 202 and the diffuser portion 203, the refrigerant is brought into a state "g", and then flows out of the ejector 106. The two-phase gas-liquid refrigerant in the state "g" that has flowed out of the ejector 106 is divided into a liquid refrigerant and a gas refrigerant by the gas-liquid separator 107. The refrigerant in a state "h" that has flowed out of the liquid refrigerant outlet of the gas-liquid separator 107 is brought into a state "i" at the fourth flow control valve 113, and flows into the evaporator 108. The refrigerant in the state "i" absorbs heat from the outdoor air in the evaporator 108 so as to be in the state "j", and flows into the ejector suction portion 204. On the other hand, the refrigerant in the state "a" that has flowed out of a gas refrigerant outlet of the gas-liquid separator 107 is guided to the suction port of the compressor 101. Although not shown, a gas refrigerant pipe inside the gas-liquid separator 107 is formed in a U-shape and has an oil hole. Thus, oil that has accumulated in the gas-liquid separator 107 flows into the compressor 101 together with the gas refrigerant.

With these operations, a refrigeration cycle is formed.

Figure 4:
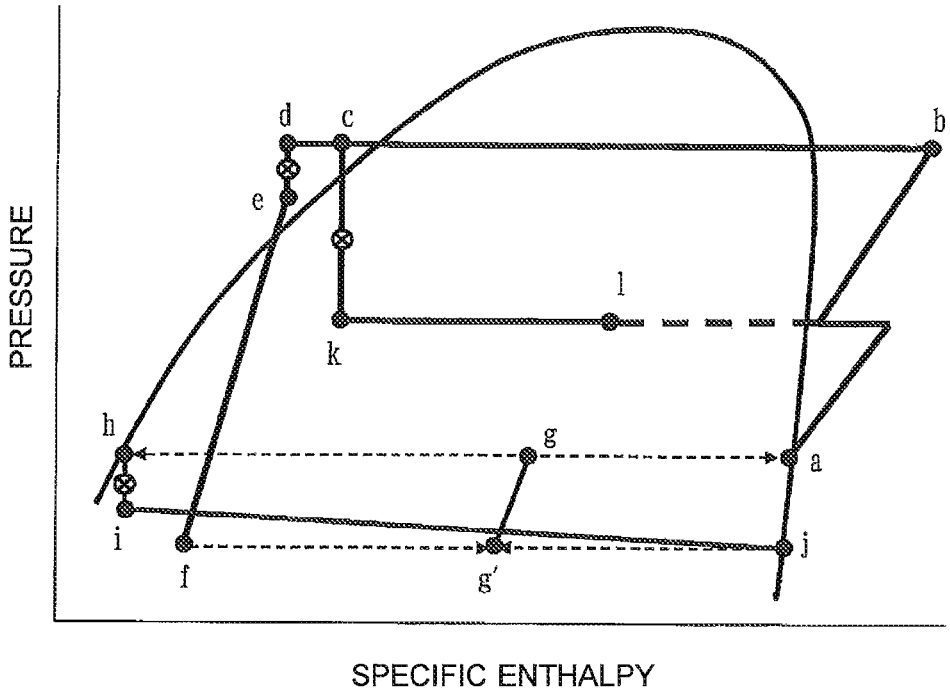
FIG. 4 is a Mollier chart according to Embodiment 1 of the present invention.

The operations illustrated in FIG. 4 correspond to the state in which both the injection and the ejector 106 are used, i.e., the state of a circuit 2 in FIG. 3(*b*). When the refrigeration cycle in this state is used, the suction pressure of the compressor 101 is increased due to the pressure increasing effect of the ejector 106, compared with the case where the ejector is not used. Thus, the power consumption of the compressor 101 is reduced, so that the COP is improved. Further, the refrigerant flow rate into the condenser 103 is increased by injection of the refrigerant into the compressor, so that the capacity can be increased.

The first bypass circuit 110 may be used when the outdoor air temperature is lower than B (e.g., lower than 2 degrees C.), and this outdoor air temperature B may be set in a temperature range in which a capacity-improved operation is started. In this case, the passage cross-sectional area of the ejector throat portion 201*b* of FIG. 2 and the length of the throat and tapered portions may be designed to form a throttle suitable for the outdoor air temperature.

Figure 5:
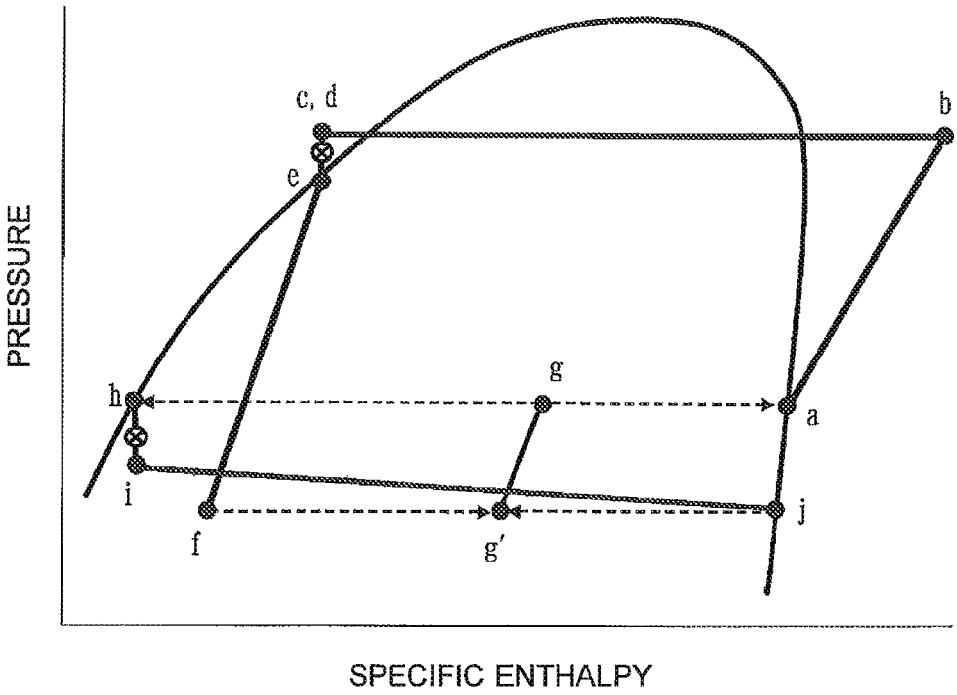
FIG. 5 is a Mollier chart according to Embodiment 1 of the present invention.

Next, a description will be given of operations that, when the outdoor air temperature is B or higher, achieve a sufficient heating capacity without using injection of a refrigerant into the compressor 101, and realize high-efficiency using an ejector, with reference to a Mollier chart of FIG. 5. In this case, the opening degrees of the first flow control valve 105 and the fourth flow control valve 113 are set in accordance with a control operation described below, while the second flow control valve 109 and the third flow control valve 111 are fully closed. The operations illustrated in FIG. 5 correspond to the state of a circuit 3 in FIG. 3(*b*).

The refrigerant in a state "a" that has flowed into the compressor 101 is brought into a high-temperature high-pressure state "b". The refrigerant in the state "b" is cooled in the condenser 103 through heat exchange with the indoor air so as to be in a state "c". The refrigerant in the state "c" that has flowed out of the condenser passes through a high-pressure-side refrigerant passage of the supercooler 104, and then flows into the ejector 106. At this point, since the second flow control valve 109 is closed, the refrigerant does not flow into the first bypass circuit 110. Accordingly, heat exchange is not performed in the supercooler 104, and hence the state of the refrigerant at the outlet of the supercooler is the same as the state "c". The refrigerant in a state "d" flowing toward the ejector 106 is subjected to pressure reduction by the first flow control valve 105 so as to be in a state "e", is subjected to pressure reduction by the pressure reducing portion 201*a* so as to be in a state "f", and is ejected from the nozzle outlet as a high-speed two-phase gas-liquid refrigerant. The refrigerant in the state "f" immediately after ejection from the nozzle outlet is mixed with the refrigerant in a state "j" that has flowed from the ejector suction portion 204 so as to be in a state "g". After the pressure is increased in the mixing portion 202 and the diffuser portion 203, the refrigerant is brought into a state "g", and then flows out of the ejector 106. The two-phase gas-liquid refrigerant in the state "g" that has flowed out of the ejector 106 is separated into a liquid refrigerant and a gas refrigerant by the gas-liquid separator 107. Thus, the liquid refrigerant is in a state "h", and the gas refrigerant is in the state "a". The liquid refrigerant in the state "h" that has flowed out of the liquid refrigerant outlet of the gas-liquid separator 107 is brought into a state "ri" at the fourth flow control valve 113, and flows into the evaporator 108. The refrigerant in the state "i" absorbs heat from the outdoor air in the evaporator 108 so as to be in the state "j", and flows into the ejector suction portion 204. On the other hand, the gas refrigerant in the state "a" that has flowed out of the gas refrigerant outlet of the gas-liquid separator 107 is guided to the suction port of the compressor 101.

With these operations, a refrigeration cycle is formed.

When this refrigeration cycle is used, the suction pressure of the compressor 101 is increased due to the pressure increasing effect of the ejector, compared with the case where the ejector is not used. Thus, the power consumption of the compressor 101 is reduced, so that the COP is improved.

Figure 6:
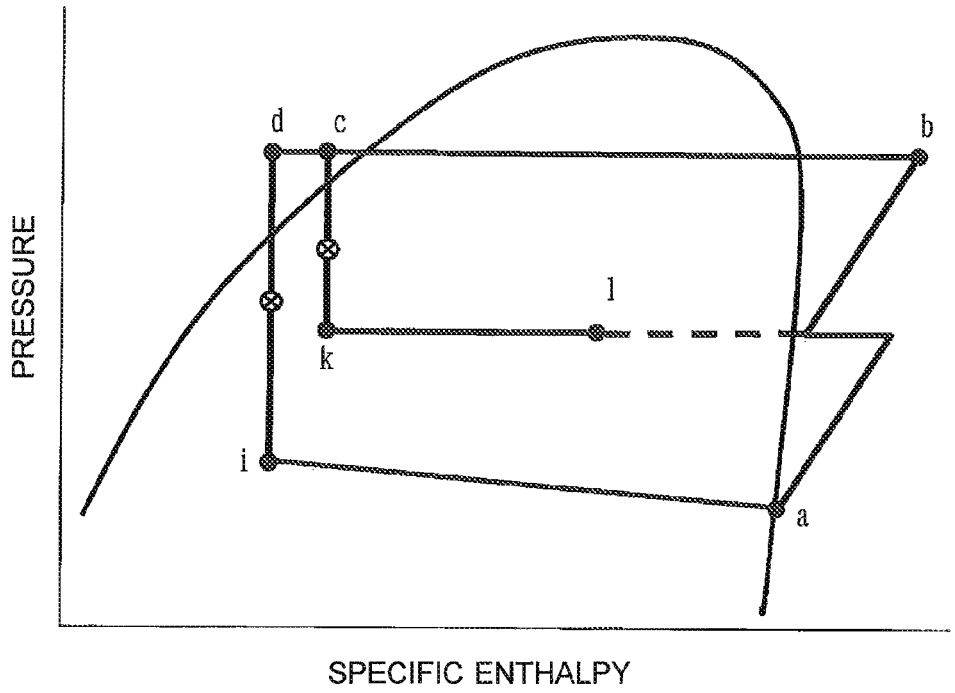
FIG. 6 is a Mollier chart according to Embodiment 1 of the present invention.

Next, a description will be given of operations that perform only a capacity-improved operation without using an ejector with reference to a Mollier chart of FIG. 6 in a case where at under the outdoor air temperature A (e.g., lower than −15 degrees C.) which requires a capacity increase by injection of a refrigerant into the compressor, an improvement in the efficiency cannot be expected due to a reduction in the suction flow rate of the ejector and a reduction in the pressure rise by the ejector that are caused by a reduction in the power recovery efficiency of the ejector 106.

In this case, the first flow control valve 105 and the fourth flow control valve 113 are fully closed, while the opening degrees of the second flow control valve 109 and the third flow control valve 111 are adjusted in accordance with a control operation. The state shown in the Mollier chart of FIG. 6 corresponds to the state under the outdoor air temperature A in FIG. 3(*a*), or the state of a circuit 1 of FIG. 3(*b*).

The low-pressure refrigerant in a state "a" at the suction port of the compressor 101 is compressed to be in a state "b" by the compressor 101. The refrigerant in the state "b" passes through the refrigerant four-way valve 102 and is cooled in the condenser 103 through heat exchange with the indoor air so as to be in a state "c". The refrigerant in the state "c" is divided into a refrigerant that flows toward the refrigerant inlet of the ejector 106 and a refrigerant that flows toward the first bypass circuit 110. The refrigerant in the state "c" that has flowed into the first bypass circuit 110 is subjected to pressure reduction by the second flow control valve 109 so as to be in a state "k", and then flows into a low-pressure-side inlet of the supercooler 104. The high-temperature high-pressure refrigerant in the state "c" flowing toward the third flow control valve 111 flows into the high-pressure-side inlet of the supercooler. In the supercooler 104, the low-temperature low-pressure refrigerant in the state "k" and the high-temperature high-pressure refrigerant in the state "c" exchange heat with each other. Thus, the refrigerant in the state "k" is heated so as to be in a state "l", and then is injected into the intermediate pressure of the compressor. The refrigerant in the state "c" flowing through the high-pressure-side passage of the supercooler 104 is cooled so as to be in a state "d", and flows into the third flow control valve 111. The flow rate of the refrigerant in the state "d" is restricted by the third flow control valve 111, so that the refrigerant is brought into a state "i". Then, the refrigerant flows into the evaporator 108. In the evaporator 108, the refrigerant is brought into a state "j" through heat exchange with the outdoor air. After that, the refrigerant flows through the suction portion 204 of the ejector 106 and the gas refrigerant outlet of the gas-liquid separator 107 so as to be in the state "a", and then is suctioned into the compressor 101.

With these operations, a refrigeration cycle is formed. Thus, the refrigerant flow rate into the condenser 103 is increased by injection of the refrigerant into the compressor, so that the capacity can be increased.

Figure 7:
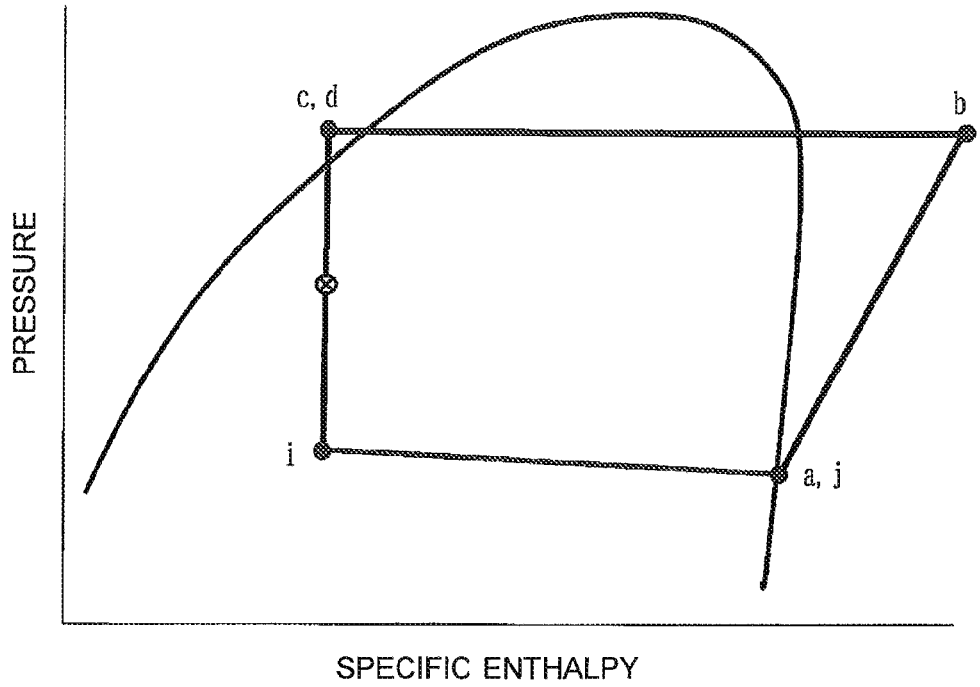
FIG. 7 is a Mollier chart according to Embodiment 1 of the present invention.

Next, a description will be given of operations using a conventional refrigeration cycle without using the ejector 106 and injection with reference to a Mollier chart of FIG. 7 in a case where, when the outdoor air temperature is C or higher (e.g., 7 degrees C. or higher), the power recovery efficiency of the ejector 106 is reduced and therefore the suction flow rate of the ejector 106 and the pressure rise by the ejector 106 are reduced. The state shown in the Mollier chart of FIG. 7 corresponds to the state over the outdoor air temperature C in FIG. 3(*a*), or the state of a circuit 4 of FIG. 3(*c*). In this case, the first flow control valve 105, the second flow control valve 109, and the fourth flow control valve 113 are fully closed, while the opening degree of the third flow control valve 111 is adjusted in accordance with a control operation described below.

The refrigerant in a state "a" that has flowed into the compressor 101 is brought into a high-temperature high-pressure state "b". The refrigerant in the state "b" is cooled in the condenser 103 through heat exchange with the indoor air so as to be in a state "c". The refrigerant in the state "c" that has flowed out of the condenser 103 passes through the high-pressure-side refrigerant passage of the supercooler 104, and then flows into the third flow control valve 111. At this point, since the second flow control valve 109 is closed, the refrigerant does not flow into the first bypass circuit 110. Accordingly, heat exchange is not performed in the supercooler 104, and hence the state "d" of the refrigerant at the outlet of the supercooler is the same as the state "c". The flow rate of the refrigerant that has flowed out of the condenser 103 is restricted by the third flow control valve 111, so that the refrigerant is brought into a state "i". Then the refrigerant flows into the evaporator 108. The refrigerant that has flowed into the evaporator 108 is brought into a state "j" through heat exchange with the outdoor air. After that, the refrigerant flows via the suction portion 204 and the mixing portion 202 of the ejector 106 through the gas refrigerant outlet of the gas-liquid separator 107 so as to be in the state "a", and then is suctioned into the compressor.

With this operation, even if the nozzle portion of the ejector 106 is clogged, it is possible to provide a refrigeration cycle having a high reliability by using a bypass circuit.

Next, a description will be given of a defrosting operation.

Since the outdoor heat exchanger serves as an evaporator during a heating operation, the saturation temperature of the refrigerant flowing in the outdoor heat exchanger is lower than the temperature of the outdoor air. When the evaporating temperature falls below 0 degrees C., water vapor in the atmosphere turns into frost and adheres to the outdoor heat exchanger. The frost on the outdoor heat exchanger increases thermal resistance, and hence the evaporation capacity decreases. Therefore, it is necessary to perform a defrosting operation regularly. In a defrosting operation, the four-way valve 102 switches the passages such that the first flow control valve 105, the second flow control valve 109, and the fourth flow control valve 113 are fully closed while the third flow control valve 111 is opened.

When a defrosting operation starts, the four-way valve 102 switches the passages such that a refrigerant that has flowed out of the compressor 101 flows into the outdoor heat exchanger 108. The frost on the outdoor heat exchange is melted by the high-temperature high-pressure refrigerant. In this case, the outdoor heat exchanger 108 serves as a condenser. Thus, the refrigerant is liquefied, is subjected to pressure reduction by the third flow control valve 111, and flows into an indoor heat exchanger. The refrigerant that has flowed into the indoor heat exchanger evaporates through heat exchange with the indoor air, sequentially passes through the suction portion 204 of the ejector 106, the mixing portion 202, the diffuser portion 203, and the gas-liquid separator 107, and is suctioned into the compressor 101. Thus, a refrigeration cycle is formed. In a cooling operation, as in the case of the defrosting operation, a refrigeration cycle is formed by appropriately controlling the opening degree of the third flow control valve 111. Although the refrigeration cycle diagram of the cooling operation is similar to that of FIG. 7, since the direction in which the refrigerant flows is switched by the four-way valve 102, some of symbols representing pipe positions differ from those in FIG. 7.

Next, a description will be given of a method of controlling the flow control valves 105, 109, 111, and 113.

Figure 9:
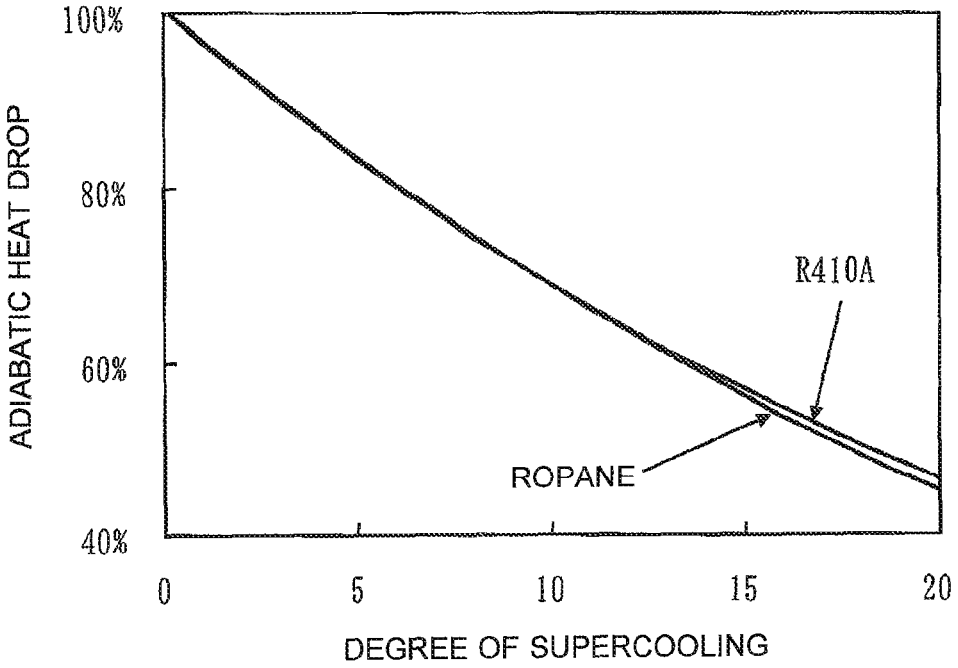
FIG. 9 is a chart showing a relationship between the adiabatic heat drop and the degree of supercooling according to Embodiment 1.

The power that can be recovered by the ejector 106 is obtained by the product of the adiabatic heat drop (the enthalpy difference from an ejector nozzle state to a state adiabatically expanded to an outlet pressure of the ejector nozzle), the refrigerant flow rate into the ejector nozzle portion 201, and the power recovery efficiency (ejector efficiency). FIG. 9 is a chart showing a relationship between the degree of supercooling of the refrigerant and the adiabatic heat drop of each of a fluorocarbon refrigerant R410A and a propane refrigerant. When the degree of supercooling is 0, the refrigerant is in a saturated liquid state. As the degree of supercooling increases, the adiabatic heat drop decreases. Accordingly, the degree of supercooling of the refrigerant in the point "ni" in FIG. 1 and FIG. 4 may be controlled by the first flow control valve 105 so as to increase the adiabatic heat drop.

Figure 8:
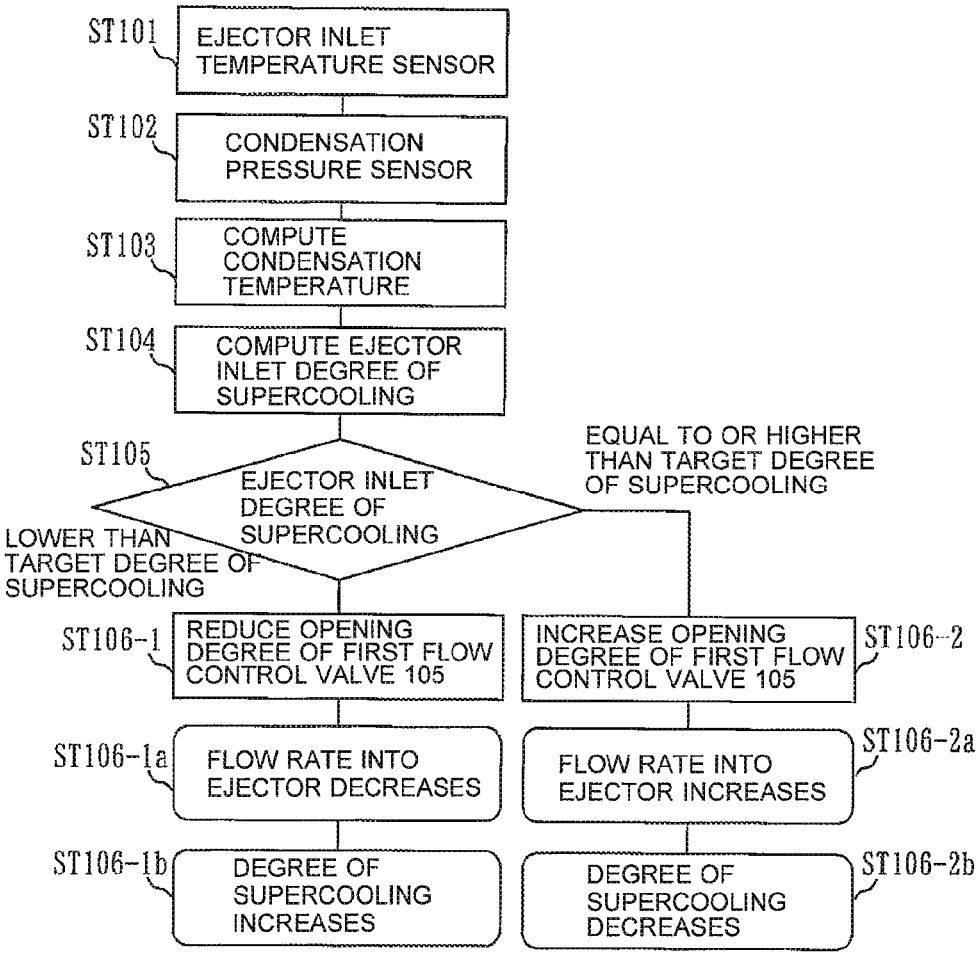
FIG. 8 is a control flow chart of a first flow control valve according to Embodiment 1 of the present invention.

FIG. 8 shows a control flow of the first flow control valve 105.

In ST101, the temperature sensor 116 attached to the outlet of the supercooler 104 detects a temperature. In ST102, the pressure sensor 117 attached to a discharge pipe of the compressor 101 detects a pressure. In ST103, a saturation temperature of the refrigerant is computed based on the pressure value detected in Step ST102. In ST104, the degree of supercooling in the point "ni" at the outlet of the supercooler 104 is computed from the difference between the computed value of the saturation temperature of the refrigerant and the detected temperature value of the outlet of the supercooler. A determination is made on this computed value of the degree of supercooling in ST105, and then the opening degree of the first flow control valve 105 is controlled.

If the computed value of the degree of supercooling is less than a target value, the opening degree of the first flow control valve 105 is reduced in ST106-1 so as to reduce the refrigerant flow rate (ST106-1*a*) and thereby increase the degree of supercooling (ST106-1*b*). When the target value of the supercooling is greater, the opening degree of the first flow control valve 105 is increased in ST106-2 so as to increase the refrigerant flow rate (ST106-2*a*) and thereby reduce the degree of supercooling (ST103-2*b*). This operation is repeated periodically so as to control the degree of supercooling in the point "ni" at the outlet of the supercooler 104. Referring to FIG. 9, it is preferable that target value of the degree of supercooling be small. However, in the case where the resolution of the detected value of the temperature sensor used when computing the degree of superheat is about 1 degrees C., when the target value is set to about 2-5 degrees C., the adiabatic heat drop is increased, so that the recovery power in the ejector 106 is increased.

Figure 10:
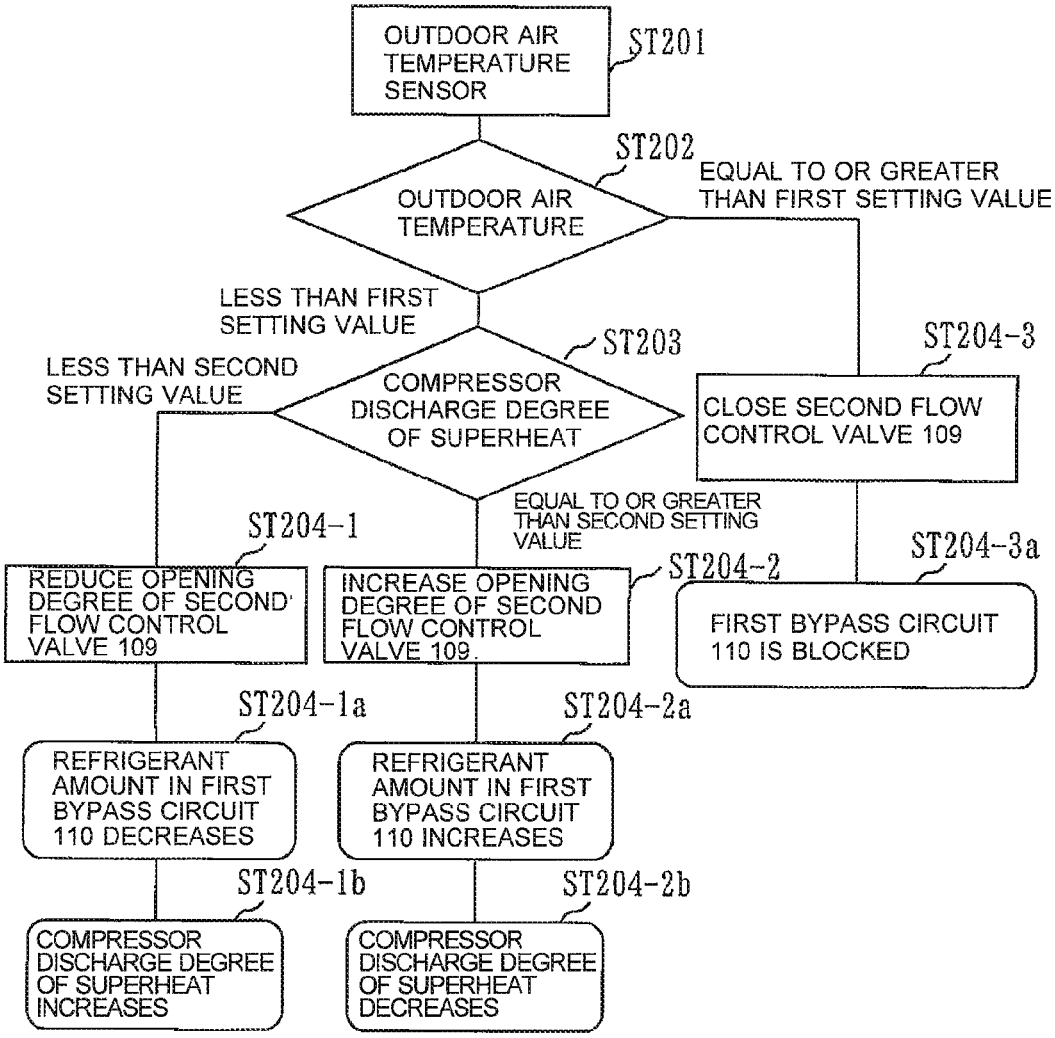
FIG. 10 is a control flow chart of a second flow control valve according to Embodiment 1 of the present invention.

Next, a description will be given of control of the second flow control valve 109 with reference to FIG. 10.

In ST201, the outdoor air temperature sensor 118 detects the outdoor air temperature. In ST202, it is determined whether to open or close the second flow control valve 109 based on this detected value. When the detected value of the outdoor air temperature sensor 118 is less than a first setting value, the second flow control valve 109 is opened. When the detected value is equal to or greater than the first setting value, the second flow control valve 109 is closed. It is to be noted that the first setting value may be set to a temperature at which the heating capacity starts decreasing in the case where the second flow control valve 109 is in a closed state.

If the detected value is less than the first setting value and it is determined to open the second flow control valve 109 in ST202, the opening degree is controlled based on a computed value of the degree of superheat of the refrigerant discharged from the compressor 101 in ST203. The degree of superheat of the refrigerant discharged from the compressor 101 is computed from the difference between a detected value of the temperature sensor 119 attached to a discharge pipe of the compressor 101 and a saturation temperature of the refrigerant, which is calculated on the basis of a detected value of the pressure sensor 117 attached to the discharge pipe of the compressor 101. When the degree of superheat is less than a second setting value in ST203, the opening degree of the second flow control valve 109 is reduced in ST204-1. Thus, the refrigerant flow rate into the first bypass circuit 110 decreases (ST204-1*a*), so that the degree of superheat increases (ST204-1*b*). When the degree of superheat is equal to or greater than the second setting value in ST203, the opening degree of the second flow control valve 109 is increased in ST204-2. Thus, the refrigerant flow rate into the first bypass circuit 110 is increased (ST204-2*a*), so that the degree of superheat is reduced (ST204-2*b*). This operation is repeated periodically so as to control the degree of superheat of the refrigerant discharged from the compressor 101 in the point "b".

If the second setting value is small, the refrigerant flow rate into the first bypass circuit 110 is increased, and therefore the low-pressure refrigerant flowing in the supercooler cannot be sufficiently evaporated. Thus, the refrigerant containing a large amount of liquid refrigerant is injected into the intermediate pressure of the compressor 101, which may result in a trouble of the compressor. Accordingly, the second setting value may preferably be set by taking the reliability of the compressor into consideration.

Next, a description will be given of control of the third flow control valve 111.

Figure 11:
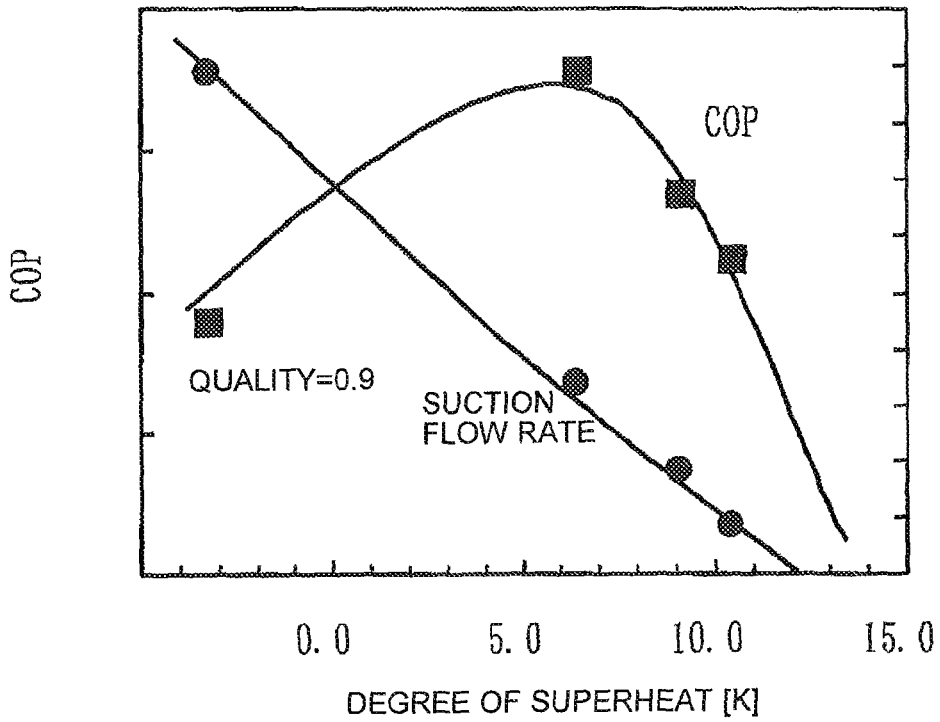
FIG. 11 is a chart showing a relationship between the degree of superheat and the COP and a relationship between the degree of superheat and the suction flow rate according to Embodiment 1.

FIG. 11 is a chart showing a relationship between the degree of superheat in the ejector suction portion 204 and the suction flow rate and a relationship between the degree of superheat and the COP based on a pilot test. It is seen from the chart that the suction flow rate monotonically decreases as the degree of superheat increases, and that the COP reaches a peak when the degree of superheat in the ejector suction portion 204 is 6 degrees C. and then falls sharply. Accordingly, in the case where the degree of superheat is higher than 6 K (e.g., 10 K), the power recovery operation of the ejector 106 may be stopped and a refrigeration cycle using the second bypass circuit 112 may be used by opening the third flow control valve 111 so as to perform an operation with a higher efficiency.

Figure 12:
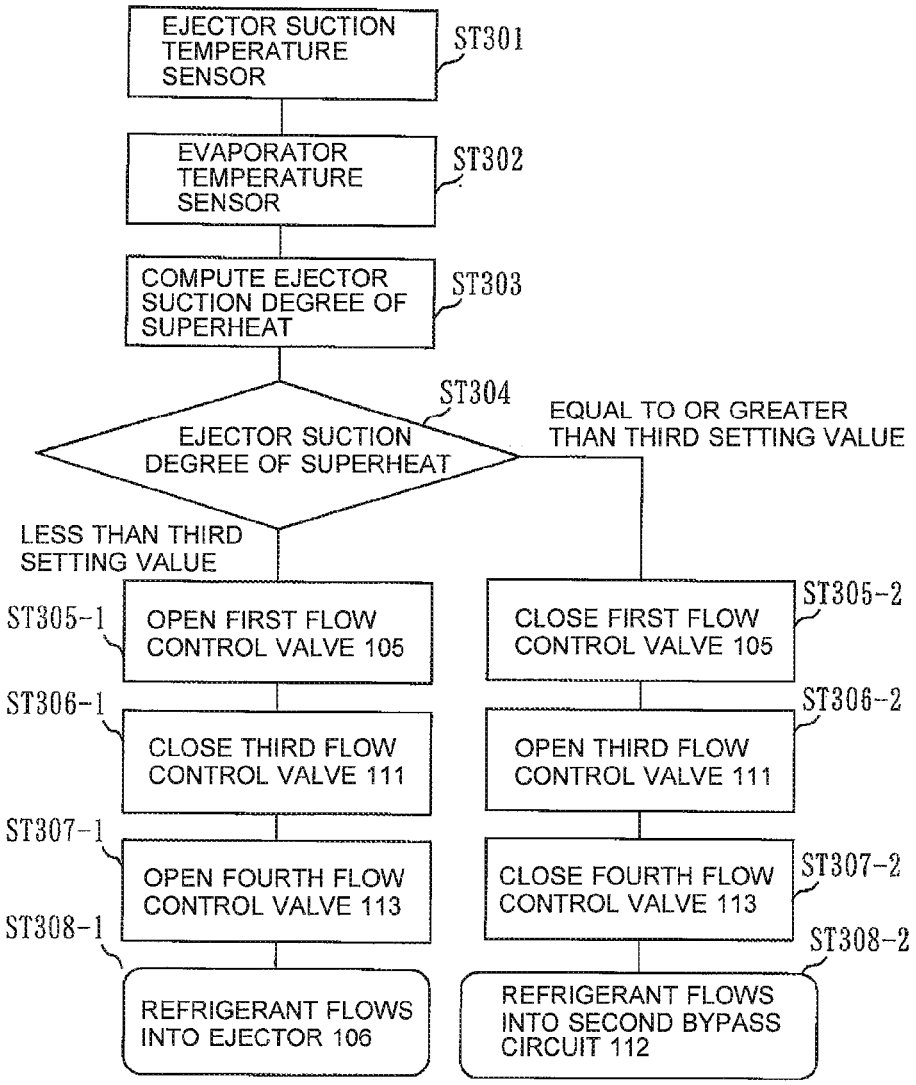
FIG. 12 is a control flow chart of the first flow control valve, a third flow control valve, and a fourth flow control valve according to Embodiment 1 of the present invention.

FIG. 12 is a control flow chart of the third flow control valve 111. In ST301, the temperature sensor 120 detects the refrigerant temperature in a point "nu" of the ejector suction portion 204. In ST302, the temperature sensor 121 detects the evaporator inlet temperature. Then in ST303, the difference between the value detected in ST301 and the value detected in ST302 is calculated so as to obtain the degree of superheat in the ejector suction portion 204.

In ST304, when the degree of superheat is lower than a third setting value, it is determined that the ejector 106 is suctioning the refrigerant. Then, the first flow control valve 105 is opened (ST305-1); the third flow control valve 111 is closed (ST306-1); and the fourth flow control valve 113 is opened (ST307-1). Thus, the refrigerant is caused to flow into the ejector 106 (ST308-1) so as to perform a high efficiency operation using the ejector 106. On the other hand, when the degree of superheat is higher than the third setting value in ST304, the suction flow rate of the ejector 106 is reduced, and hence the ejector 106 is determined to be in an abnormal state. Then, the operation is switched to an operation using a circuit in which the first flow control valve 105 is closed (ST305-2); the third flow control valve 111 is opened (ST306-2); the fourth flow control valve 113 is closed (ST307-2); and the refrigerant is caused to flow into the second bypass circuit 112 so as to bypass the ejector 106 (ST308-2).

The third setting value may be set to be lower than or equal to 6 degrees C. at which the COP starts decreasing as shown in FIG. 11. However, without being limited thereto, when it is desired to improve the evaporation capacity by increasing the suction flow rate of the ejector 106, the third setting value may be set to be lower than 6 degrees C.

Figure 13:
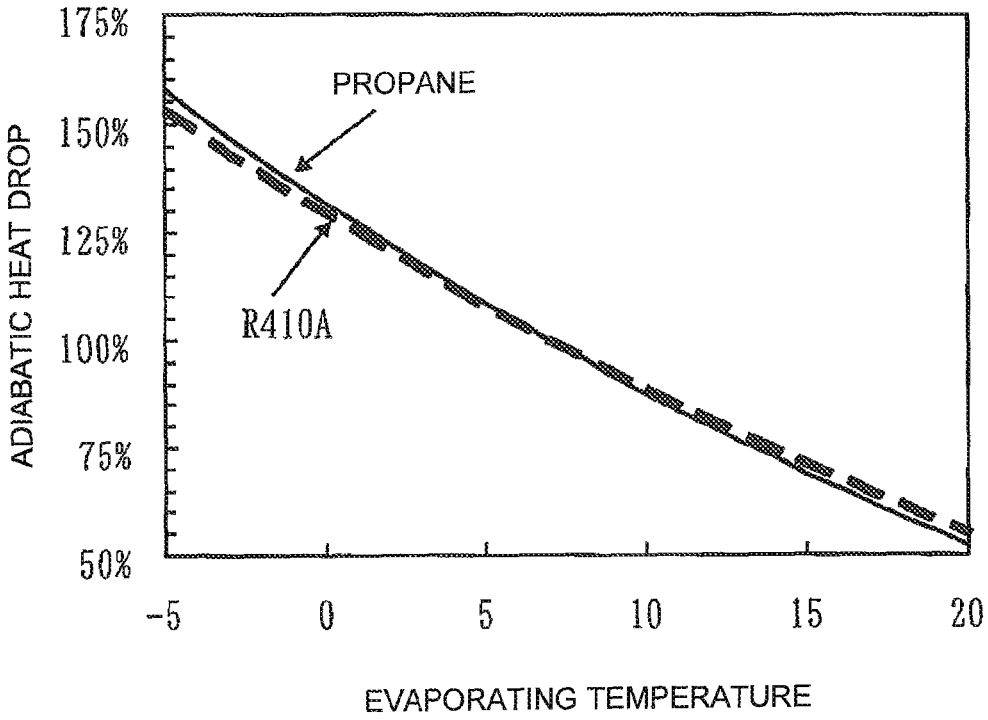
FIG. 13 is a chart showing a relationship between the adiabatic heat drop and the evaporating temperature according to Embodiment 1.

Further, the third flow control valve 111 may be controlled in accordance with the outdoor air temperature. FIG. 13 is a chart showing a relationship of the evaporating temperature of the refrigeration cycle, which varies in accordance with a variation in the outdoor air temperature, with the adiabatic heat drop in the case where the pressure and the temperature in the point "ni" are close to those in an actual operation state. As can be seen from FIG. 13, when the evaporating temperature rises, the adiabatic heat drop decreases. Thus, the recovery power of the ejector decreases. As a result, the suction flow rate of the ejector and the pressure rise by the ejector decrease, so that the COP decreases.

It is to be noted that a pressure sensor may be provided at a refrigerant inlet of the evaporator 108 such that the degree of superheat in the ejector suction portion 204 can also be calculated on the basis of a detected value of this pressure sensor and a detected value of the temperature sensor 120 at the suction portion of the ejector.

On the other hand, at low outdoor air temperatures, the ejector is unable to achieve an optimum expansion for the refrigeration cycle, so that the power recovery efficiency is reduced. Thus, as shown in FIG. 3, the COP in an operation using the ejector is lower than that in an operation using a regular cycle. In this case, an operation is performed without using the ejector.

Figure 14:
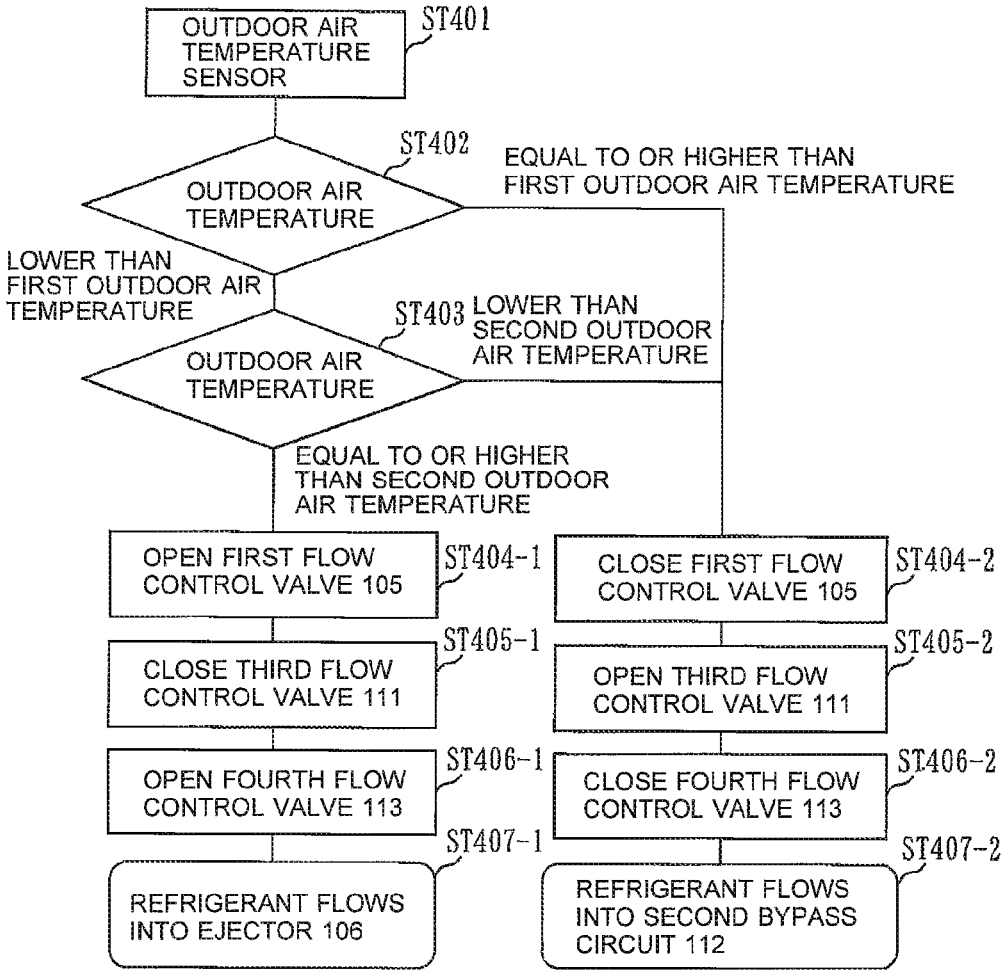
FIG. 14 is a control flow chart of the first flow control valve, the third flow control valve, and the fourth flow control valve according to Embodiment 1 of the present invention.

FIG. 14 is a flow chart for controlling the third flow control valve 111 in accordance with the outdoor air temperature. In ST401, the outdoor air temperature sensor 118 detects the outdoor air temperature. In ST402, when the detected outdoor air temperature is equal to or higher than a first outdoor air temperature, the second bypass circuit 112 is used without using the ejector. In this case, the first flow control valve 105 is closed in ST404-2; the third flow control valve 111 is opened in ST405-2; and the fourth flow control valve 113 is closed in ST406-2. Thus, the refrigerant flows into the bypass circuit (ST407-2). Even if the outdoor air temperature is lower than the first outdoor air temperature, when the detected value of the outdoor air temperature sensor 118 is lower than a second outdoor air temperature, the control valves are controlled by performing the above-described steps of ST404-2, ST405-2, ST406-2, and ST407-2. When the detected value of the temperature sensor 118 is lower than the first outdoor air temperature and is equal to or higher than the second outdoor air temperature, the first flow control valve 105 is opened in ST404-1; the third flow control valve is closed in ST405-2; and the fourth flow control valve 113 is opened in ST405-3. Thus, the refrigerant is caused to flow into the ejector (ST407-1), and thereby a refrigeration cycle is operated while performing a power recovery operation using the ejector 106.

The setting values of the first outdoor air temperature and the second outdoor air temperature may be set in a temperature range in which it is desired to improve the efficiency using the ejector, and the ejector may be designed such that the power recovery efficiency of the ejector have a maxima value in this temperature range.

Further, a determination of whether to open or close the third flow control valve 111 may be made based on the rotation speed of the compressor 101. The recovery power of the ejector 106 is obtained by the product of the adiabatic heat drop, the ejector-driven refrigerant flow rate, and the power recovery efficiency. Accordingly, in the case where the ejector-driven refrigerant flow rate is high, that is, the case where the rotation speed of the compressor 101 is high, a high-efficiency operation using the ejector is performed. When the refrigerant flow rate is low, the recovery power decreases, so that the suction refrigerant flow rate of the ejector 106 decreases. Thus, the degree of superheat in the ejector suction portion rises, so that the COP decreases as shown in FIG. 11. Accordingly, when the rotation speed of the compressor 101 is equal to or lower than a fourth setting value, the ejector 106 is determined to be in an abnormal state. Thus, a refrigeration cycle is operated with not using the ejector 106 but using the third control valve 111.

Figure 15:
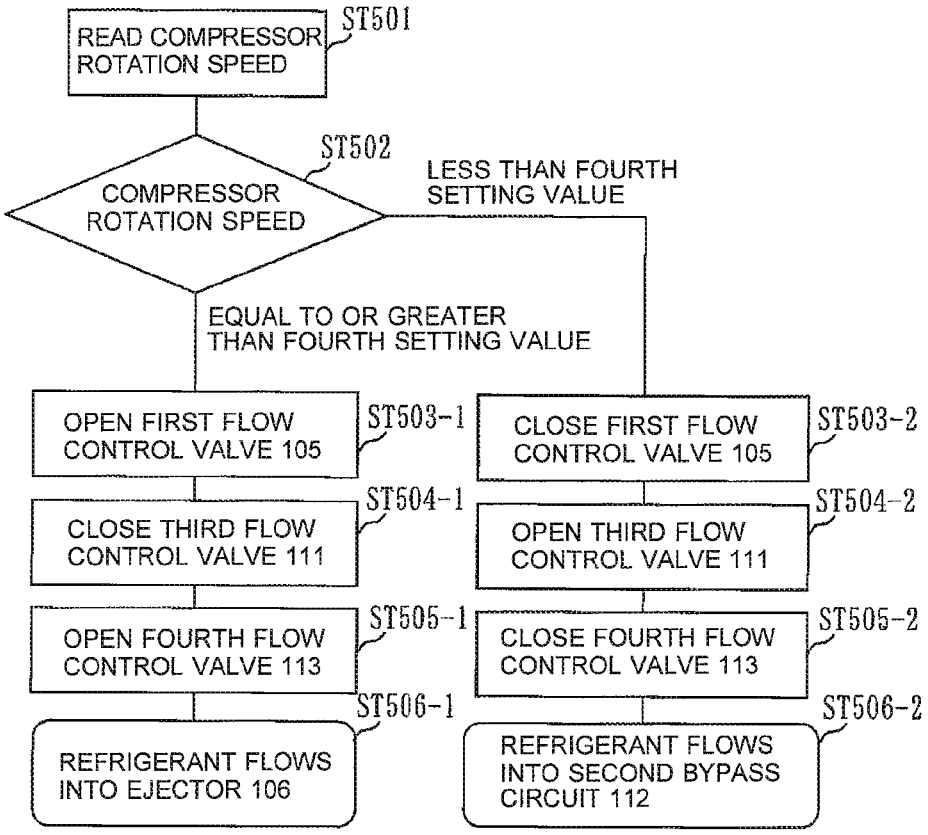
FIG. 15 is a control flow chart of the first flow control valve, the third flow control valve, and the fourth flow control valve according to Embodiment 1 of the present invention.

FIG. 15 is a control flow chart for controlling opening and closing of the third flow control valve 111 in accordance with the rotation speed of the compressor 101.

Detecting means for detecting the rotation speed of the compressor detects the rotation speed in ST501, and it is determined whether to open or close the flow control valves 105, 111, and 113 in accordance with the rotation speed of the compressor in ST502. When the compressor rotation speed is equal to or greater than the fourth setting value, the first flow control valve 105 is opened in ST503-1; the third flow control valve 111 is closed in ST504-1; and the fourth flow control valve 113 is opened in ST505-1. Thus, the refrigerant flows into the ejector 106 (ST506-1).

When the compressor rotation speed is less than the fourth setting value, the first flow control valve 105 is closed in ST503-2; the third flow control valve 111 is opened in ST504-2; and the fourth flow control valve 113 is closed in ST505-2. Thus, the refrigerant flows into the second bypass circuit (ST506-2).

Next, a description will be given of control of the fourth flow control valve 113.

As shown in FIG. 11, when the refrigerant in the ejector suction portion 204 is in a two-phase state (in a point of a dryness=0.95 in FIG. 11), the recovery efficiency of the ejector is high, and therefore the ejector suctions the refrigerant excessively. That is, the refrigeration cycle can be operated with the maximum COP by controlling the opening degree of the fourth flow control valve 113 and thereby the suction refrigerant amount of the ejector.

Figure 16:
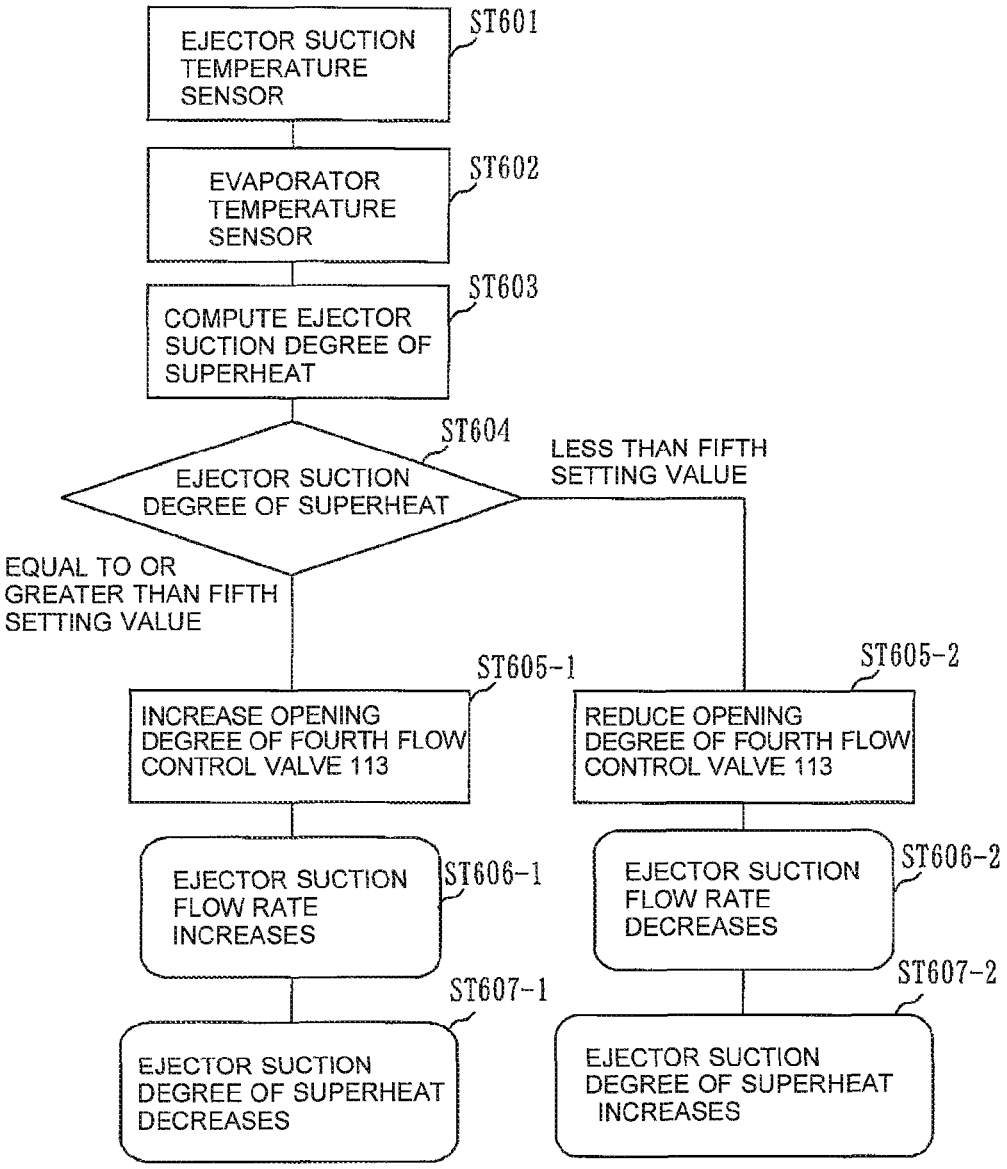
FIG. 16 is a control flow chart of the fourth flow control valve according to Embodiment 1 of the present invention.

FIG. 16 is a control flow chart of the fourth flow control valve 113. A detected value of the temperature sensor 120 attached to the suction portion 204 of the ejector 106 is read in ST601, and the temperature sensor 121 attached to the inlet of the evaporator detects a temperature in ST602. The degree of superheat of the refrigerant in the point "nu" in FIG. 1 is calculated from the difference between the temperatures detected in ST601 and ST602. When this degree of superheat is equal to or higher than a fifth setting value (e.g., lower than 5 degrees C.) in ST604, the opening degree of the fourth flow control valve 113 is increased in ST605-1. Thus, the refrigerant amount in the ejector suction portion is increased (ST606-1), and the degree of superheat in the ejector suction portion is reduced (ST607-1). On the other hand, when the degree of superheat is determined to be lower than the fifth setting value in ST604, the opening degree of the fourth flow control valve 113 is reduced in ST605-2. Thus, the refrigerant amount in the ejector suction portion is reduced (ST606-2), and the degree of superheat in the ejector suction portion is increased (ST607-2). When the fifth setting value is set to be less than the fourth setting value, an operation with a high COP can be performed.

As can be seen from the above, according to this embodiment, it is possible to perform a high-capacity operation at low outdoor air temperatures using the compressor 101 having an injection port, and a high-efficiency operation using power recovery by the ejector 106. Also, it is possible to provide diversity in the operating condition of the refrigerant circuit by opening and closing the flow control valve. When the recovery power of the ejector is reduced due to a change in the outdoor air temperature or the frequency of the compressor, an operation can be performed using second bypass circuit 112 without using the ejector. Further, when the nozzle portion of the ejector is clogged, the second bypass circuit 112 is used which is provided in parallel with the ejector. Thus, it is possible to provide a refrigeration cycle apparatus having a high efficiency and a high reliability.

Figure 17:
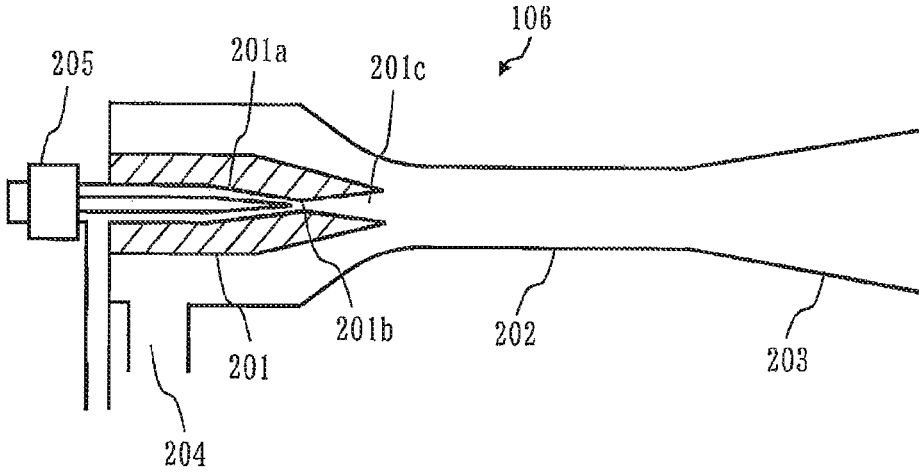
FIG. 17 is a diagram showing an internal structure of an ejector having a variable throttle mechanism according to Embodiment 1.
Figure 17:
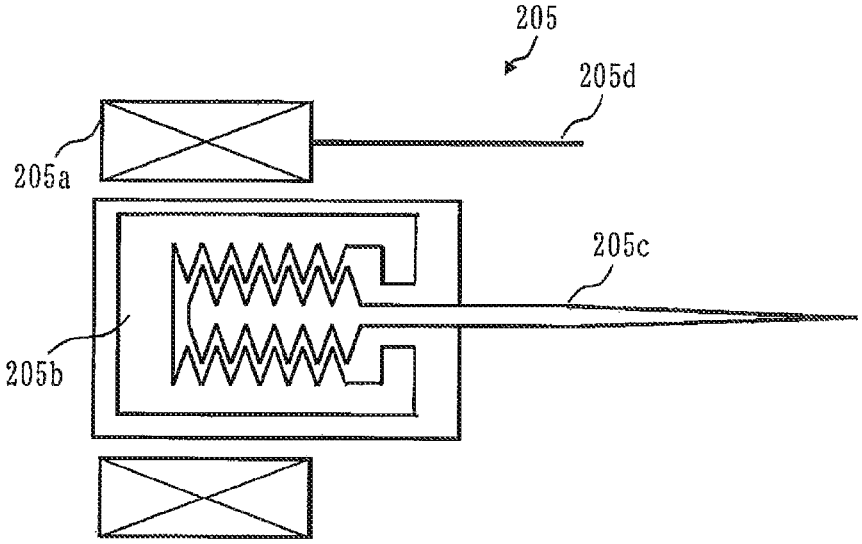

In this embodiment, the first flow control valve 105 is provided upstream of the ejector 106. However, as shown in FIG. 17, an ejector that integrates the ejector 106 and a movable needle valve 205 may be used. FIG. 17(*a*) is a diagram showing an entire configuration of an ejector having a needle valve, and FIG. 17(*b*) is a diagram showing a configuration of the needle valve 205. The needle valve 205 includes a coil portion 205*a*, a rotor portion 205*b*, and a needle portion 205*c*. When the coil portion 205*a* receives a pulse signal from the control signal transmitter 303 through a signal cable 205*d*, the coil portion 205*a* generates a magnetic pole, so that the rotor portion 205*b* inside the coil rotates. A screw and a needle are formed in a rotary shaft of the rotor portion 205*b*. Accordingly, a rotation of the screw is converted into an axial movement, and thus the needle portion 205*c* is moved. The driven flow rate of the refrigerant flowing from the condenser 103 can be controlled by moving the needle portion 205*c* in a lateral direction in the figure. With this configuration, the movable needle valve 205 can replace the function of the first flow control valve 105. In this way, the ejector 106 and the first flow control valve 105 can be integrated into one unit, which eliminates the need for a pipe for connecting these two components and thus reduces the costs.

Further, although a compressor having an injection port is used in the present embodiment, the present invention is not limited thereto. The same effects can be obtained by using an equivalent structure, for example, a two-stage compressor and a plurality of compressors that may be connected in series such that refrigerants discharged from a first one of the compressors and a low-pressure-side refrigerant in the supercooler 104 are mixed with each other and are suctioned into a second one of the compressors. In this case, the same effects can be obtained.

Embodiment 2

Figure 18:
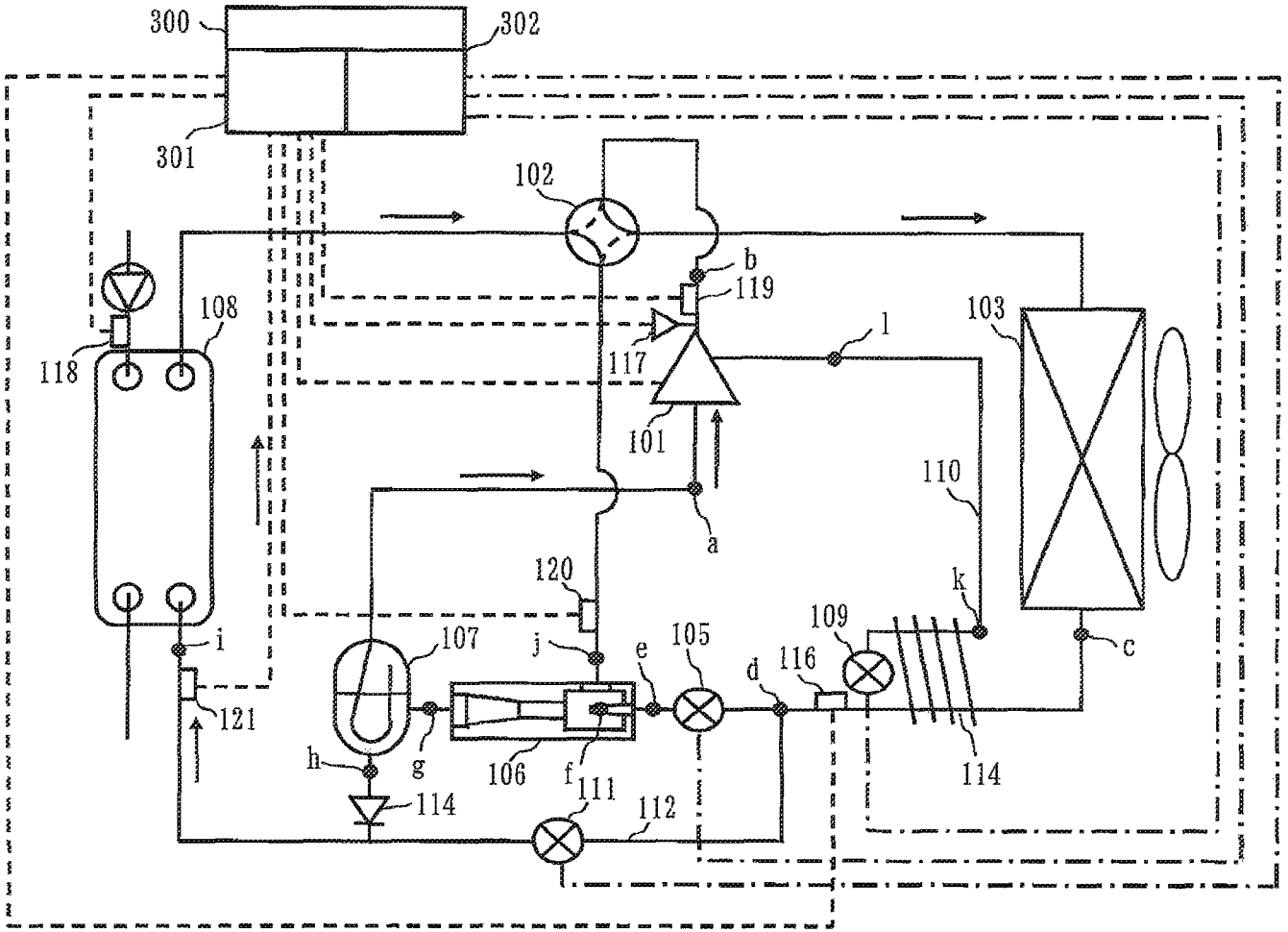
FIG. 18 is a schematic diagram showing a refrigeration cycle apparatus according to Embodiment 2 of the present invention.

FIG. 18 is a diagram showing a refrigeration cycle apparatus having another configuration according to the present invention.

While the heat exchanger serving as the evaporator 108 is an air heat exchanger in Embodiment 1, a heat exchanger used in Embodiment 2 is a water heat exchange. Other components denoted by the same reference signs as in Embodiment 1 in a configuration diagram and characteristic diagrams have the same configurations and functions as those of Embodiment 1. A check valve 114 is provided at a liquid refrigerant outlet of the gas-liquid separator 107 in place the fourth flow control valve 113 in order to achieve a cost reduction. Further, the second flow control valve 109 is attached to the outlet of the supercooler 104 in place of the inlet thereof. Since the performance of the supercooler does not affect its attachment position, the attachment position may be selected in accordance with the layout of a refrigerant pipe in an outdoor unit that is mounted at the site.

Figure 20:
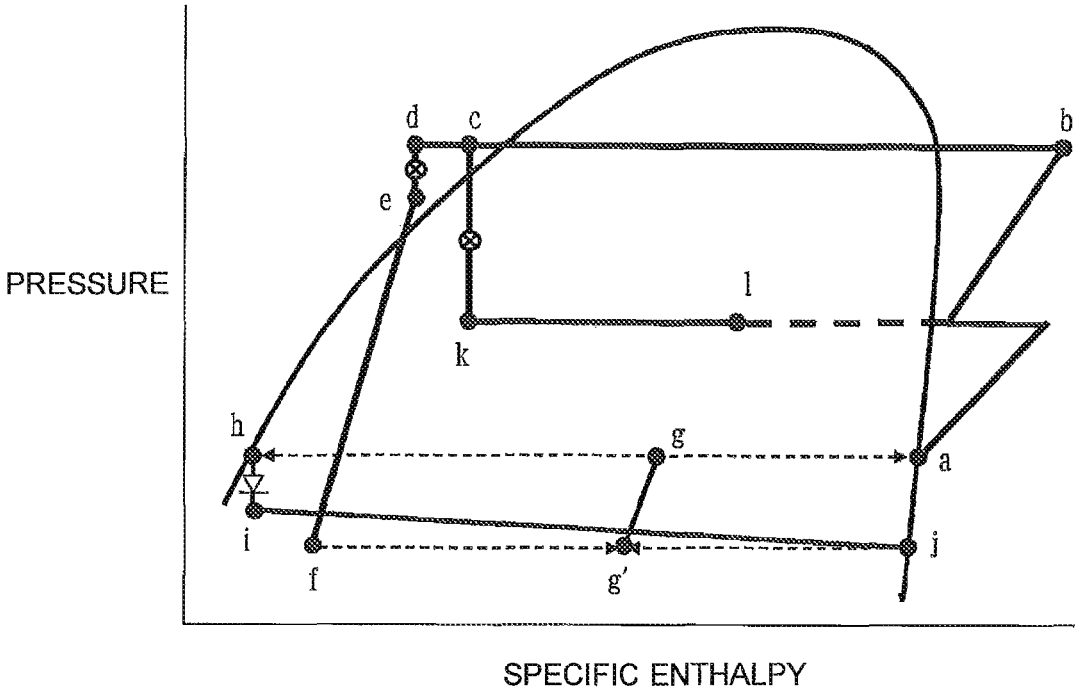
FIG. 20 is a Mollier chart according to Embodiment 2 of the present invention.

FIG. 20 is a Mollier chart of Embodiment 2. Points "a"-"l" in the chart indicate the states of the refrigerant at the corresponding points in the pipes of the refrigeration cycle of FIG. 18. The states of the refrigerant in Embodiment 2 are the same as those in Embodiment 1 except that a state "d"

of the refrigerant flowing into a first flow control valve 105 is the same as a state "c" of the refrigerant flowing into a second flow control valve 109.

Figure 19:
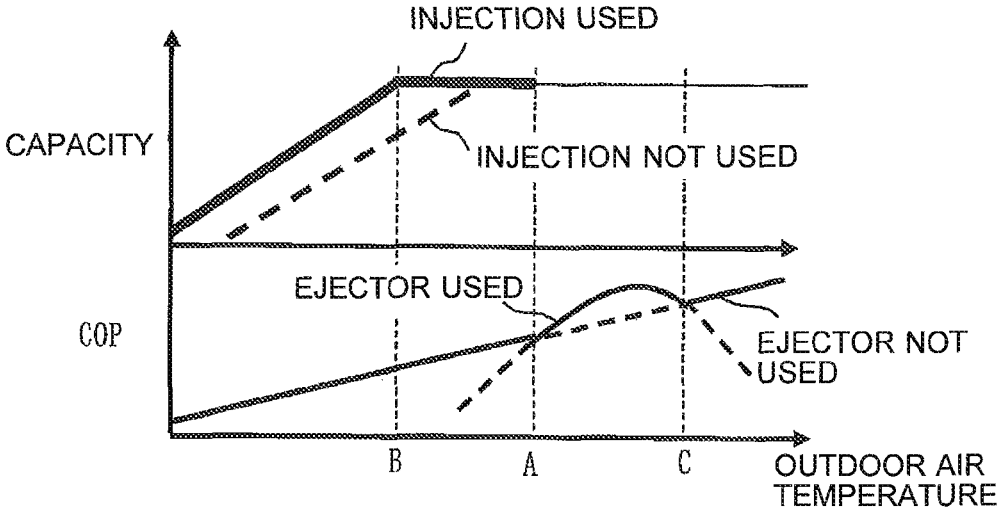
FIG. 19 is a chart showing a relationship between the outdoor air temperature and the heating capacity and a relationship between the outdoor air temperature and the COP according to Embodiment 2.

In this embodiment, with regard to a generating temperature of cold water, when a feed water temperature is 12 degrees C. and an outflow temperature is 5 degrees C., for example, it is possible to perform a high-capacity operation without using injection of a refrigerant into the compressor 101. In such an operation, a temperature range in which an ejector is used may be set to a high-temperature range between A and C as shown in FIG. 19 so as to achieve a high-efficiency operation. In FIG. 19, similar to FIG. 3(*a*), the horizontal axis represents the outdoor air temperature, and the vertical axis represents the capacity and the COP. Further, water that flows into the evaporator may be brine. When the generation temperature in the case of brine is low (e.g., minus 5 degrees C.), the refrigerant is injected into a compressor 101 such that a high-capacity operation and a high-efficiency operation can be performed.

Embodiment 3

Figure 21:
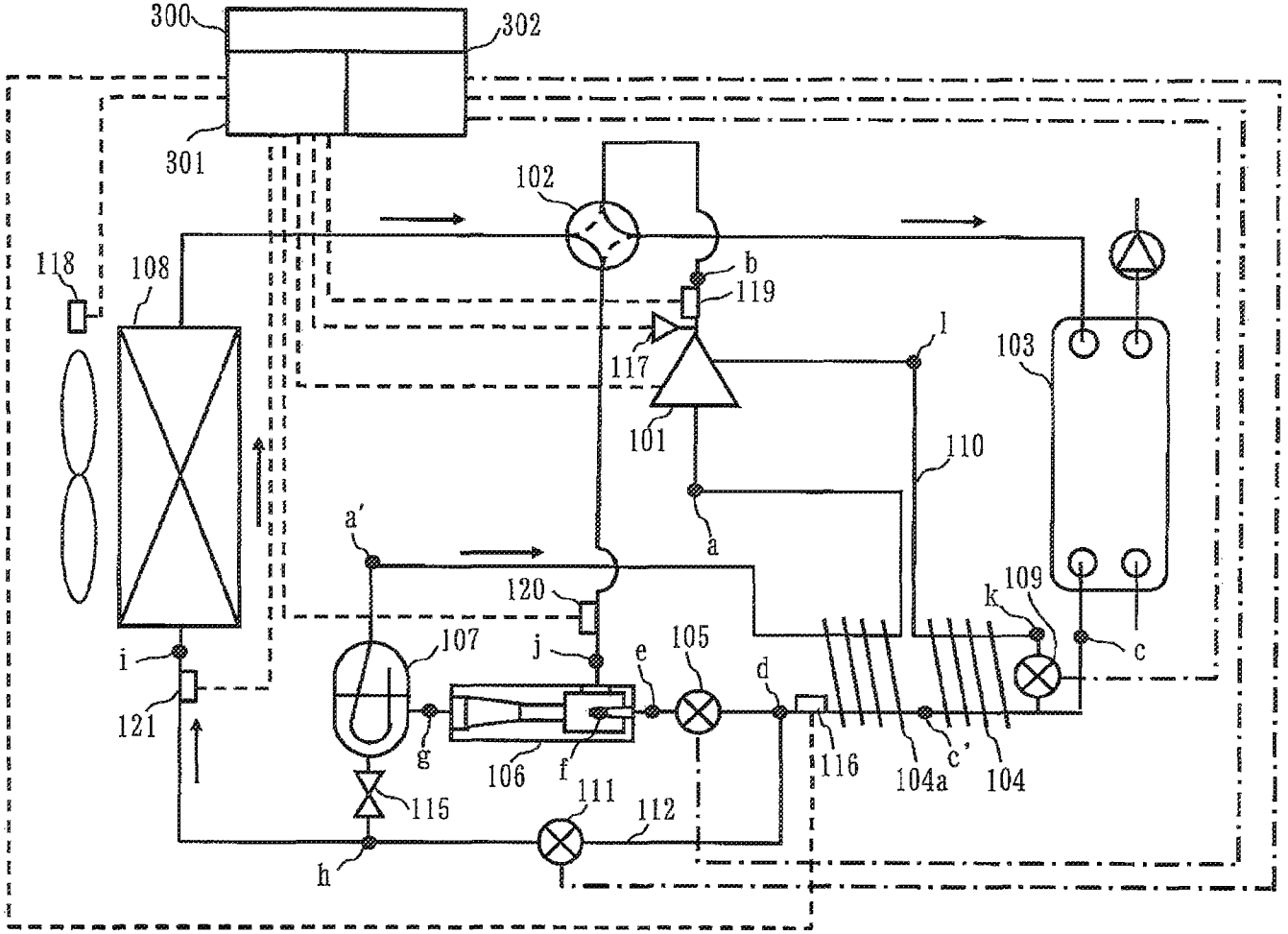
FIG. 21 is a schematic diagram showing a refrigeration cycle apparatus according to Embodiment 3 of the present invention.

FIG. 21 is a diagram showing a refrigeration cycle apparatus having another configuration according to the present invention.

While the heat exchanger serving as the condenser 103 is an air heat exchanger in Embodiment 1, a heat exchanger used in Embodiment 3 is a water heat exchange for hot water generation (water heater). Other components denoted by the same reference signs as in Embodiment 1 in a configuration diagram and characteristic diagrams have the same configurations and functions as those of Embodiment 1.

Figure 22:
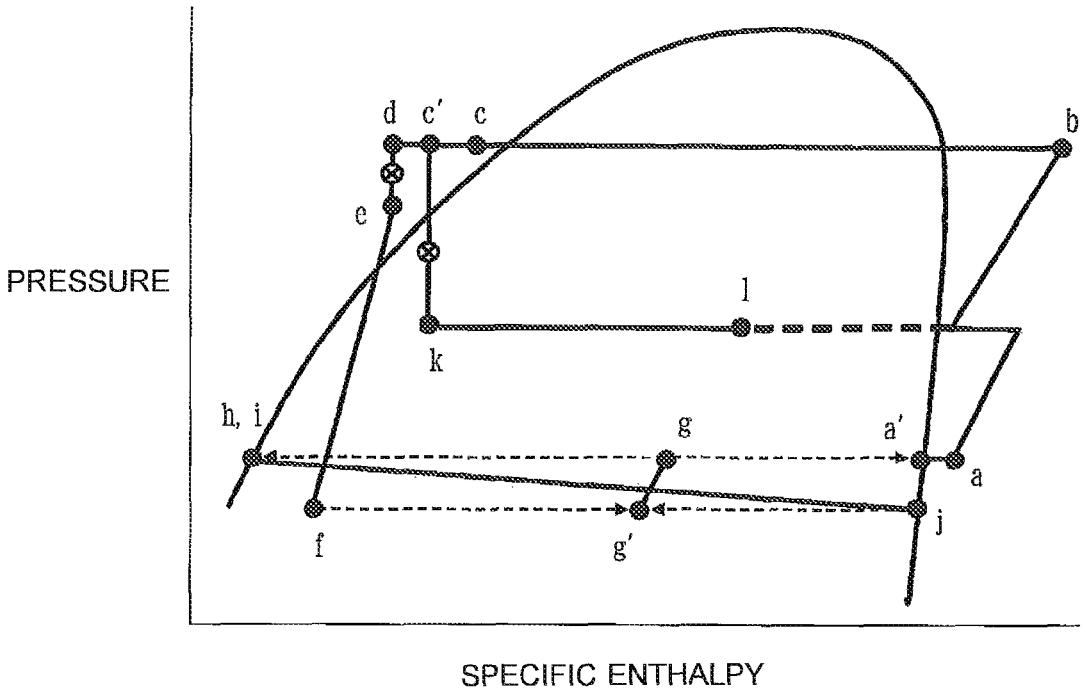
FIG. 22 is a Mollier chart according to Embodiment 3 of the present invention.

FIG. 22 is a Mollier chart of Embodiment 3. Points "a"-"l" in the chart indicate the states of the refrigerant at the corresponding points in the pipes of the refrigeration cycle of FIG. 21. In Embodiment 3, a refrigerant in a state "c" that has flowed out of a condenser 103 is cooled so as to be in a state "c'", and is further cooled through heat exchange with a low-temperature low-pressure refrigerant in a state "g'", which has flowed out of a gas refrigerant outlet of a gas-liquid separator 107, in a second supercooler 104*a* so as to be in a state "d". The refrigerant in the state "d" flows into the ejector 106. A gas refrigerant in a state "a'" at the gas refrigerant outlet of the gas-liquid separator 107 is heated through heat exchange with a high-temperature high-pressure refrigerant in the state "c'" so as to be in a state "a". Then, the refrigerant is suctioned into the compressor 101. On the other hand, a refrigerant in a state "h" at the liquid refrigerant outlet of the gas-liquid separator 107 passes through an opening and closing valve 115 so as to be in a state "i". The refrigerant absorbs heat from the outdoor air in the evaporator 108 so as to be in a state "j", and then flows into the suction portion 204 of the ejector 106.

In this embodiment, the opening and closing valve 115 is provided in place of the first flow control valve 105 connected to the liquid refrigerant outlet of the gas-liquid separator 107 so as to reduce pressure loss. Further, in the configuration of Embodiment 1, a separation efficiency of the gas-liquid separator 107 is low. Therefore, the liquid refrigerant may flow into the compressor suction, which may result in a reduced concentration of refrigerant oil in the compressor or a seizure due to liquid compression. In this embodiment, the second supercooler 104*a* is provided such that a two-phase gas-liquid refrigerant flowing out of the gas-liquid separator 107 is completely evaporated and is suctioned into the compressor. This can improve the reliability of the compressor.

The refrigerant used in the refrigeration cycles of the present Embodiments 1 to 3 may include fluorocarbon refrigerants such as R410A, and natural refrigerants such as propane and carbon dioxide. The same effects as those of the present embodiments can be obtained by using propane or CO2. In this case, although propane is a flammable refrigerant, if an evaporator and a condenser are disposed spaced apart from each other in the same housing and if hot water or cold water that has been subjected to heat exchange by a water heat exchanger as described in Embodiment 2 or 3 is circulated, it is possible to provide a safe refrigeration cycle apparatus. Also, the same effects can be obtained by using a low GWP HFO-based refrigerant or a refrigerant mixture thereof.

INDUSTRIAL APPLICABILITY

According to the present invention, it is possible to provide a refrigeration cycle apparatus that solves the problem of a reduction in the capacity and efficiency under operational conditions of low outdoor air temperatures by use of a compressor having an injection and an ejector and that is therefore capable of performing a high-capacity operation and a high-efficiency operation. Also, in the case where the refrigeration cycle apparatus is used in air-conditioning apparatuses, chillers, and water heaters, when an ejector is appropriately designed under operational conditions which contribute the most to the annual power consumption, it is possible to reduce the annual power consumption.

Although the refrigeration cycle apparatus has been described in the above embodiments, this refrigeration cycle apparatus may be embodied as a refrigerant circulation method as described below.

More specifically, this refrigeration cycle apparatus may be embodied as:

a refrigerant circulation method including the steps of:

forming a high-pressure-side refrigerant circuit in which a compressor, a condenser, an ejector, and a gas-liquid separator are connected in series with a refrigerant pipe;

forming a low-pressure refrigerant circuit in which a liquid refrigerant that has flowed out of the gas-liquid separator flows through a fourth flow control valve and an evaporator to a refrigerant suction portion of the ejector;

forming a compressor suction circuit that connects an upper outlet of the gas-liquid separator to a suction port of the compressor such that a gas refrigerant that has flowed out of the gas-liquid separator is suctioned into the compressor;

forming a first bypass circuit that connects a point between the condenser and the ejector of the high-pressure refrigerant circuit to an intermediate pressure portion of the compressor via a second flow control valve; and forming a second bypass circuit that connects a point between a first flow control valve and an internal heat exchanger to a point between the fourth control valve and the evaporator of the low-pressure refrigerant circuit via a third flow control valve so as to allow a high-pressure refrigerant to take a bypass, the first flow control valve being disposed between the internal heat exchanger and the ejector, the internal heat exchanger being configured to exchange heat between a refrigerant whose pressure has been reduced at the second flow control valve and the high-pressure refrigerant flowing in the high-pressure-side refrigerant circuit;

wherein, while the second flow control valve is opened such that the refrigerant flows through the first bypass circuit, the fourth flow control valve is switched to be opened or closed, and the third flow control valve is switched to be opened or closed.

REFERENCE SIGNS LIST

101 compressor; 102 four-way valve; 103 condenser; 104 supercooler; 104*a* second supercooler; 105 first flow control valve; 106 ejector; 107 gas-liquid separator; 108 evaporator; 109 second flow control valve; 110 first bypass circuit; 111 third flow control valve; 112 second bypass circuit; 113 fourth flow control valve; 114 check valve; 115 opening and closing valve; 116, 118, 119, 120, 121 temperature sensor; 117 pressure sensor; 201 nozzle; 201*a* pressure reducing portion; 201*b* throat portion; 201*c* tapered portion; 202 mixing portion; 203 diffuser portion; 204 suction portion; 205 needle valve; 205*a* coil portion; 205*b* rotor portion; 205*c* needle portion; 205*d* signal cable; 300 control unit; 301 detected value receiver; and 302 control signal transmitter.

The invention claimed is:

1. A refrigeration cycle apparatus comprising:

a high-pressure-side refrigerant circuit in which a compressor, a condenser, an ejector, and a gas-liquid separator are connected in series with a refrigerant pipe;

a low-pressure refrigerant circuit in which a liquid refrigerant that has flowed out of the gas-liquid separator flows through a fourth flow control valve and an evaporator to a refrigerant suction portion of the ejector;

a compressor suction circuit that connects an upper outlet of the gas-liquid separator to a suction port of the compressor such that a gas refrigerant that has flowed out of the gas-liquid separator is suctioned into the compressor;

a first bypass circuit that connects a point between the condenser and the ejector of the high-pressure refrigerant circuit to an intermediate pressure portion of the compressor via a second flow control valve;

an internal heat exchanger that exchanges heat between a refrigerant whose pressure has been reduced at the second flow control valve of the first bypass circuit and a high-pressure refrigerant flowing in the high-pressure-side refrigerant circuit; and a second bypass circuit that connects a point between a first flow control valve and the internal heat exchanger to a point between the fourth control valve and the evaporator of the low-pressure refrigerant circuit via a third flow control valve so as to allow the high-pressure refrigerant to take a bypass, the first flow control valve being disposed between the internal heat exchanger and the ejector;

wherein while the second flow control valve is opened such that the refrigerant flows through the first bypass circuit, the fourth flow control valve is switched to be opened or closed, and the third flow control valve is switched to be closed or opened, and wherein when a detected value of an outdoor air temperature detector is equal to or higher than a first outdoor air temperature and is lower than a second outdoor air temperature that is higher than the first outdoor air temperature, an opening degree of the first flow control valve is controlled such that a difference between a detected value of a temperature detector provided at a refrigerant outlet of the internal heat exchanger of the high-pressure-side refrigerant circuit and a saturation temperature reaches a target degree of supercooling, the saturation temperature being calculated on the basis of a detected value of a pressure detector provided at an outlet of the compressor, and when the detected value of the outdoor air temperature detector is lower than the first outdoor air temperature, the second flow control valve is controlled to be opened such that the refrigerant flows into the first bypass circuit.

2. The refrigeration cycle apparatus of claim 1, further comprising:

abnormality detecting means that determines that there is an abnormality when a degree of refrigerant superheat is equal to or higher than a third setting value, the degree of refrigerant superheat being calculated on the basis of a difference between a temperature detector attached to the ejector suction portion and a temperature detector attached to an inlet of the evaporator;

wherein when the abnormality detecting means has detected an abnormality, the first flow control valve and the fourth flow control valve are fully closed and the third flow control valve is opened such that the refrigerant flows into the first bypass circuit.

3. The refrigeration cycle apparatus of claim 1, further comprising:

an abnormality detecting means that determines that there is an abnormality when a rotation speed of the compressor is less than a predetermined rotation speed;

wherein when the abnormality detecting means has detected an abnormality, the first flow control valve and the fourth flow control valve are fully closed and the third flow control valve is opened such that the refrigerant flows into the second bypass circuit.

4. The refrigeration cycle apparatus of claim 1, wherein an opening degree of the second flow control valve is controlled such that a degree of superheat at a discharge port of the compressor becomes to a preset value, the degree of superheat being obtained by calculating a difference between a detected value of a temperature detector attached to the discharge port of the compressor and a saturation temperature computed from a detected value of a pressure detector attached to the discharge port of the compressor.

5. The refrigeration cycle apparatus of claim 1, wherein a flow rate of the fourth flow control valve is controlled such that a degree of refrigerant superheat at the refrigerant suction portion of the ejector becomes to a preset value.

6. The refrigeration cycle apparatus of claim 1, wherein a second supercooler is provided in a circuit extending between an upstream outlet of the gas-liquid separator and a point where the refrigerant is suctioned into the compressor.

7. A refrigerant circulation method comprising the steps of:

forming a high-pressure-side refrigerant circuit in which a compressor, a condenser, an ejector, and a gas-liquid separator are connected in series with a refrigerant pipe;

forming a low-pressure refrigerant circuit in which a liquid refrigerant that has flowed out of the gas-liquid separator flows through a fourth flow control valve and an evaporator to a refrigerant suction portion of the ejector;

forming a compressor suction circuit that connects an upper outlet of the gas-liquid separator to a suction port of the compressor such that a gas refrigerant that has flowed out of the gas-liquid separator is suctioned into the compressor;

forming a first bypass circuit that connects a point between the condenser and the ejector of the high-pressure refrigerant circuit to an intermediate pressure portion of the compressor via a second flow control valve; and forming a second bypass circuit that connects a point between a first flow control valve and an internal heat exchanger to a point between the fourth control valve and the evaporator of the low-pressure refrigerant circuit via a third flow control valve so as to allow a high-pressure refrigerant to take a bypass, the first flow control valve being disposed between the internal heat exchanger and the ejector, the internal heat exchanger being configured to exchange heat between a refrigerant whose pressure has been reduced at the second flow control valve and the high-pressure refrigerant flowing in the high-pressure-side refrigerant circuit;

wherein while the second flow control valve is opened such that the refrigerant flows through the first bypass circuit, the fourth flow control valve is switched to be opened or closed, and the third flow control valve is switched to be closed or opened, and wherein when a detected value of an outdoor air temperature detector is equal to or higher than a first outdoor air temperature and is lower than a second outdoor air temperature that is higher than the first outdoor air temperature, an opening degree of the first flow control valve is controlled such that a difference between a detected value of a temperature detector provided at a refrigerant outlet of the internal heat exchanger of the high-pressure-side refrigerant circuit and a saturation temperature reaches a target degree of supercooling, the saturation temperature being calculated on the basis of a detected value of a pressure detector provided at an outlet of the compressor, and when the detected value of the outdoor air temperature detector is lower than the first outdoor air temperature, the second flow control valve is controlled to be opened such that the refrigerant flows into the first bypass circuit.

8. A refrigeration cycle apparatus comprising:

a high-pressure-side refrigerant circuit in which a compressor, a condenser, an ejector, and a gas-liquid separator are connected in series with a refrigerant pipe;

a low-pressure refrigerant circuit in which a liquid refrigerant that has flowed out of the gas-liquid separator flows through a check valve and an evaporator to a refrigerant suction portion of the ejector;

a compressor suction circuit that connects an upper outlet of the gas-liquid separator to a suction port of the compressor such that a gas refrigerant that has flowed out of the gas-liquid separator is suctioned into the compressor;

a first bypass circuit that connects a point between the condenser and the ejector of the high-pressure refrigerant circuit to an intermediate pressure portion of the compressor via a second flow control valve;

an internal heat exchanger that exchanges heat between a refrigerant whose pressure has been reduced at the second flow control valve of the first bypass circuit and a high-pressure refrigerant flowing in the high-pressure-side refrigerant circuit; and a second bypass circuit that connects a point between a first flow control valve and the internal heat exchanger to a point between the check valve and the evaporator of the low-pressure refrigerant circuit via a third flow control valve so as to allow the high-pressure refrigerant to take a bypass, the first flow control valve being disposed between the internal heat exchanger and the ejector;

wherein while the second flow control valve is opened such that the refrigerant flows through the first bypass circuit, the check valve is switched to be opened or closed, and the third flow control valve is switched to be closed or opened, and wherein when a detected value of an outdoor air temperature detector is equal to or higher than a first outdoor air temperature and is lower than a second outdoor air temperature that is higher than the first outdoor air temperature, an opening degree of the first flow control valve is controlled such that a difference between a detected value of a temperature detector provided at a refrigerant outlet of the internal heat exchanger of the high-pressure-side refrigerant circuit and a saturation temperature reaches a target degree of supercooling, the saturation temperature being calculated on the basis of a detected value of a pressure detector provided at an outlet of the compressor, and when the detected value of the outdoor air temperature detector is lower than the first outdoor air temperature, the second flow control valve is controlled to be opened such that the refrigerant flows into the first bypass circuit.

9. A refrigeration cycle apparatus comprising:

a high-pressure-side refrigerant circuit in which a compressor, a condenser, an ejector, and a gas-liquid separator are connected in series with a refrigerant pipe;

a low-pressure refrigerant circuit in which a liquid refrigerant that has flowed out of the gas-liquid separator flows through an opening and closing valve and an evaporator to a refrigerant suction portion of the ejector;

a compressor suction circuit that connects an upper outlet of the gas-liquid separator to a suction port of the compressor such that a gas refrigerant that has flowed out of the gas-liquid separator is suctioned into the compressor;

a first bypass circuit that connects a point between the condenser and the ejector of the high-pressure refrigerant circuit to an intermediate pressure portion of the compressor via a second flow control valve;

an internal heat exchanger that exchanges heat between a refrigerant whose pressure has been reduced at the second flow control valve of the first bypass circuit and a high-pressure refrigerant flowing in the high-pressure-side refrigerant circuit; and a second bypass circuit that connects a point between a first flow control valve and the internal heat exchanger to a point between the opening and closing valve and the evaporator of the low-pressure refrigerant circuit via a third flow control valve so as to allow the high-pressure refrigerant to take a bypass, the first flow control valve being disposed between the internal heat exchanger and the ejector;

wherein while the second flow control valve is opened such that the refrigerant flows through the first bypass circuit, the opening and closing valve is switched to be opened or closed, and the third flow control valve is switched to be closed or opened, and wherein when a detected value of an outdoor air temperature detector is equal to or higher than a first outdoor air temperature and is lower than a second outdoor air temperature that is higher than the first outdoor air temperature, an opening degree of the first flow control valve is controlled such that a difference between a detected value of a temperature detector provided at a refrigerant outlet of the internal heat exchanger of the high-pressure-side refrigerant circuit and a saturation temperature reaches a target degree of supercooling, the saturation temperature being calculated on the basis of a detected value of a pressure detector provided at an outlet of the compressor, and when the detected value of the outdoor air temperature detector is lower than the first outdoor air temperature, the second flow control valve is controlled to be opened such that the refrigerant flows into the first bypass circuit.

* * * * *